US010427286B2

(12) United States Patent
McCann

(10) Patent No.: US 10,427,286 B2
(45) Date of Patent: Oct. 1, 2019

(54) MULTI-USE AX

(71) Applicant: Scott McCann, Nine Mile Falls, WA (US)

(72) Inventor: Scott McCann, Nine Mile Falls, WA (US)

( * ) Notice: Subject to any disclaimer, the term of this patent is extended or adjusted under 35 U.S.C. 154(b) by 223 days.

(21) Appl. No.: 14/679,962

(22) Filed: Apr. 6, 2015

(65) Prior Publication Data

US 2015/0314143 A1 Nov. 5, 2015

Related U.S. Application Data

(60) Provisional application No. 61/986,770, filed on Apr. 30, 2014, provisional application No. 62/084,892, filed on Nov. 26, 2014.

(51) Int. Cl.

| | |
|---|---|
| ***A62B 3/00*** | (2006.01) |
| ***B26B 23/00*** | (2006.01) |
| ***B25D 7/00*** | (2006.01) |
| ***B25F 1/00*** | (2006.01) |

(52) U.S. Cl.

CPC ..... *B25D 7/00* (2013.01); *A62B 3/005* (2013.01); *B25F 1/006* (2013.01); *B26B 23/00* (2013.01)

(58) Field of Classification Search

None

See application file for complete search history.

(56) References Cited

U.S. PATENT DOCUMENTS

| | | | | |
|---|---|---|---|---|
| 1,596,602 | A * | 8/1926 | Eagan | B25F 1/00 7/138 |
| 1,923,964 | A * | 8/1933 | Benton | B25F 1/006 7/145 |
| 3,599,255 | A * | 8/1971 | Carroll, Sr. | B25F 1/00 254/26 R |
| 4,287,623 | A * | 9/1981 | Tarran | B26B 23/00 7/139 |
| D266,903 | S * | 11/1982 | Tarran | D8/105 |
| D299,414 | S | 1/1989 | Bajza et al. | |
| D382,187 | S | 8/1997 | Hibben | |
| 6,289,540 | B1 * | 9/2001 | Emonds | A01B 1/022 15/141.1 |
| 6,397,420 | B1 * | 6/2002 | Roxton | A62B 3/005 7/145 |
| 6,568,016 | B1 | 5/2003 | Hoogland | |

(Continued)

FOREIGN PATENT DOCUMENTS

| | | |
|---|---|---|
| CA | 2296048 | 7/2001 |
| CA | 2728530 | 7/2012 |

(Continued)

OTHER PUBLICATIONS

Office Action for U.S. Appl. No. 15/488,150, dated Nov. 16, 2018, McCann et al, "Multi-Use Hatchet", 13 pages.

*Primary Examiner* — Brian D Keller

(74) *Attorney, Agent, or Firm* — Lee & Hayes, P.C.

(57) ABSTRACT

A multi-use ax may comprise a head and a handle, each comprising multiple functionalities. In various embodiments, the head and the handle may comprise functionalities such as an anchor and attachment point, or belay loop, to allow a user to bail out of a hazardous environment. In various embodiments the head and/or the handle may comprise functionalities to provide a means by which a user may shut off gas and/or water at various sources.

18 Claims, 17 Drawing Sheets

(56) References Cited

U.S. PATENT DOCUMENTS 6,899,001 B1 * 5/2005 Sanders ..... B25G 1/04 81/125
7,275,492 B2 10/2007 Jungblom
7,565,711 B1 7/2009 Schamadan
D604,136 S * 11/2009 Youngren ..... D8/78
D639,131 S * 6/2011 Winsor ..... D8/105
8,024,994 B2 * 9/2011 St. John ..... B25F 1/00 362/120
D653,925 S 2/2012 Hung
8,113,094 B1 * 2/2012 Brackbill ..... B25B 15/00 7/138
8,677,537 B1 * 3/2014 Ingesson ..... B25F 1/006 7/146
8,752,223 B2 6/2014 Hanlon
9,021,642 B1 * 5/2015 Fox ..... B25F 1/006 7/145
D752,407 S 3/2016 Johnson
D770,875 S 11/2016 Honadel et al.
D789,760 S 6/2017 Hung
D821,841 S 7/2018 Honadel et al.
D823,660 S 7/2018 Pirrone et al.
2004/0174700 A1 9/2004 Zirk et al.
2004/0244545 A1 12/2004 Stinnissen et al.
2004/0261188 A1 12/2004 Mathis
2006/0075572 A1 * 4/2006 Young ..... B25B 13/48 7/138
2006/0096787 A1 * 5/2006 Underwood ..... E21B 17/076 175/294
2008/0041905 A1 * 2/2008 Cavett ..... A45C 13/30 224/580
2009/0271929 A1 * 11/2009 Adams ..... B25B 13/04 7/144
2010/0199809 A1 * 8/2010 St. John ..... B25D 1/04 81/20
2011/0062400 A1 3/2011 Lindskog
2015/0113738 A1 * 4/2015 Wells ..... A62B 3/005 7/166
2015/0328499 A1 * 11/2015 Willey ..... A63B 29/08 30/359
2018/0297188 A1 10/2018 McCann et al.

FOREIGN PATENT DOCUMENTS

WO WO8002004 10/1980
WO WO2007/0145887 12/2007

* cited by examiner

MULTI-USE AX

This application claims priority to Provisional Application Ser. Nos. 61/986,770, filed Apr. 20, 2014, and 62/084,892, filed Nov. 26, 2014, the contents of which are hereby incorporated in their entirety.

BACKGROUND

Axes are commonly used in many professions, such as firefighting. Traditionally, in firefighting, axes are used for forcible entry, and at times, to provide support for a fireman operating on an unstable or dangerous surface. A standard ax is designed with a sharp head, in order to assist in splitting wood or other material.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 4A depicts a side view of the head. FIG. 4B depicts a back view of the multi-use ax head depicted in FIG. 4A.

FIG. 10A depicts a substantially ovular relief cut. FIG. 10B depicts a relief cut with a webbing hole

DETAILED DESCRIPTION

This disclosure is generally directed to a multi-use ax. The multi-use ax may comprise a head and a handle, each comprising multiple functionalities. In various embodiments, the head and the handle may comprise functionalities such as an anchor and attachment point, or belay loop, to allow a user to bail out of a hazardous environment. In various embodiments the head and/or the handle may comprise functionalities to provide a means by which a user may shut off gas and/or water at various sources.

The apparatuses and techniques described herein may be implemented in a number of ways. Example implementations are provided below with reference to the following figures.

Figure 1:
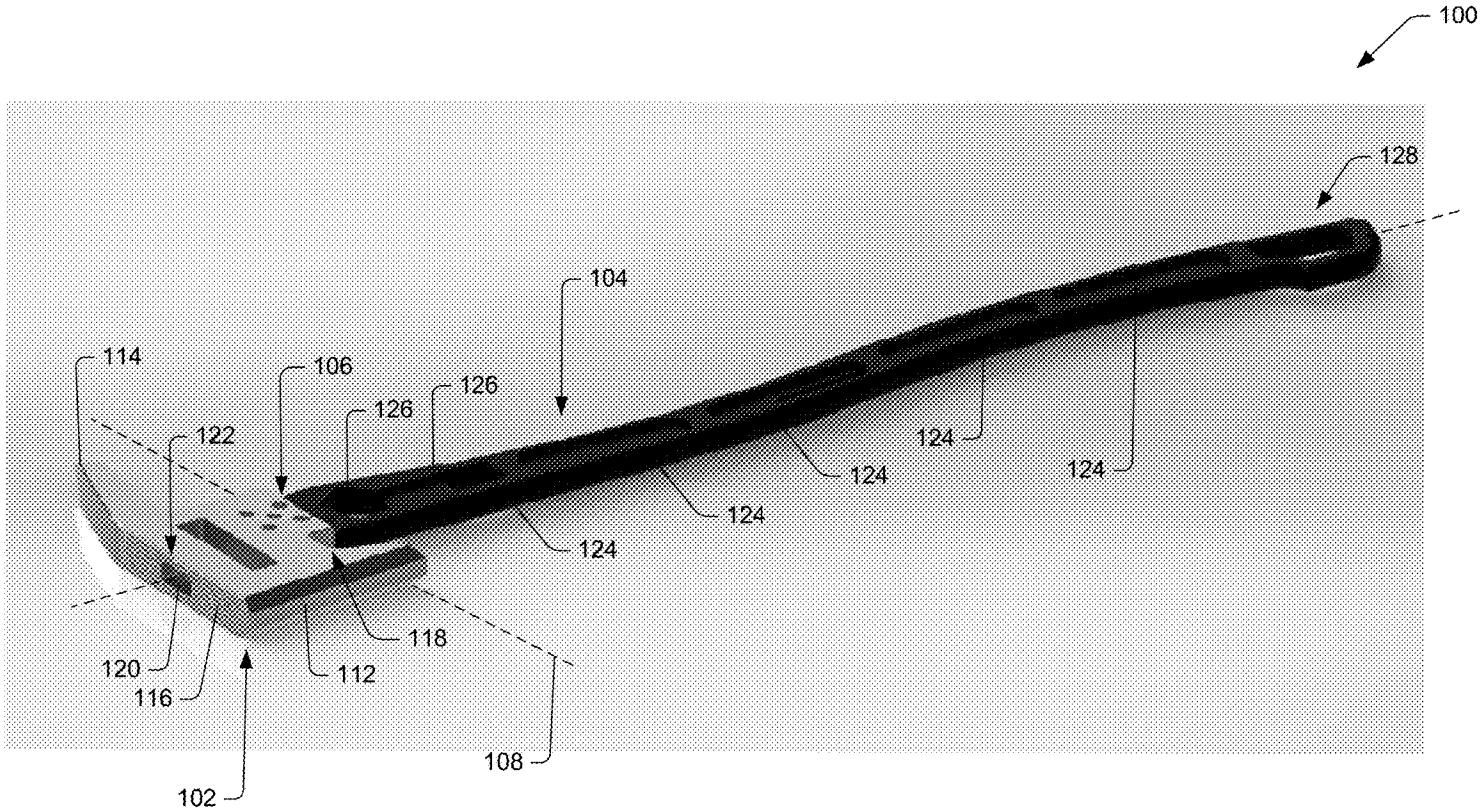
FIG. 1 is a perspective view of a multi-use ax.

FIG. 1 is a perspective view of a multiuse ax. The multi-use ax 100 may comprise a head 102, a handle 104, and an attachment point 106. As depicted in FIG. 1, the multi-use ax 100 comprises a horizontal axis 108 and a vertical axis 110.

In various embodiments, the components of the multi-use ax 100 may be manufactured via traditional manufacturing techniques. In some embodiments, the components may be manufactured by 3-D manufacturing techniques, casting, molding, forming, machining, composite manufacturing, or any other method of manufacturing. In some embodiments, the metal may be hardened during the manufacturing process.

In various embodiments, the head 102 may comprise a metal material (e.g., aluminum, steel, stainless steel, titanium, iron, alloys thereof, etc.), plastic material (e.g., high-density polyethylene, acrylic, melamine, polycarbonate, etc.), a composite material (e.g., fiberglass, carbon fiber, etc.), or combinations of the foregoing. In some embodiments, the head may be cast, formed or machined as a solid piece. In some embodiments, the head may comprise two or more pieces joined together. In at least one embodiment, the head 102 comprises steel, cast as a solid piece, and hardened to 45-55 on the Rockwell hardness scale. In some embodiments, the head 102 may comprise a hardness between 50 and 65

In various embodiments, the head 102 may have a length of 12 inches or less. In such embodiments, the multi-use ax may be sized to fit in a standard mounting bracket, which allows for quick access and easy removal when needed. In at least one embodiment, the head 102 may have a length of 10 inches. In yet other embodiments, the head 102 may have a length greater than 12 inches.

In various embodiments, the head 102 may have a width of equal to or less than 1.5 inches. In such embodiments, the head 102 may be a lighter weight, while also comprising a narrow profile, which may be useful in confined spaces. In at least one embodiment, the head 102 may have a width of 1 inch. In yet other embodiments, the head 102 may have a width greater than 1.5 inches.

As depicted in FIG. 1, the head 102 comprises an ax face 112, a pick 114, a top surface 116, and an anchor notch 118.

In various embodiments, the ax face 112 may comprise a sharp blade. In the illustrative embodiment, the ax face 112 comprises a blunt surface, flanked by beveled edges. In such an embodiment, a portion of the ax face 112 may be flat, oriented substantially perpendicular to the horizontal axis 108, while the beveled edges may be angled away from the flat portion (i.e., the blunt surface). The blunt surface may provide for a good striking surface for the ax face 112, while preventing the ax face 112 from getting pinched or wedged upon impact and/or penetration. Additionally, one possible benefit is that the beveled edges may allow a user to penetrate more material with each swing, allowing it to be a more efficient tool over at least sharp-edged conventional axes. Various embodiments contemplate that the blunt surface may be substantially flat, peaked, or curved along its length, along the edge between the bevels, or combinations thereof.

In some embodiments, the beveled edges may be angled between 15 and 85 degrees from the blunt surface of the ax face 112. In at least one embodiment, the beveled edges may be at a 45 degree angle from the blunt surface. In at least one embodiment, the blunt surface of the ax face 112 may comprise a width of about 0.5 inches, and may be centered on the ax face 112, between two beveled edges, each comprising a width of about 0.424 inches.

Additionally or alternatively, various embodiments contemplate that the ax face 112 may have a substantially smooth transition from the beveled edges to the blunt surface. For example, various embodiments contemplate that the beveled edges may provide a curved surface that may transition to the blunt surface where the blunt surface may be a flat portion or substantially curved. For example, various embodiments contemplate a smooth continuous curve from the edge of the ax face 112 through the blunt surface to the other edge of the ax face 112. Various embodiments contemplate that the surface may be defined by a piecewise continuous function where the boundary between the beveled edges and the blunt face may be smooth or sharp.

Additionally or alternatively, the ax face 112 may comprise a first portion of a blunt surface as well as a second portion of a sharp surface. For example, a top portion of the ax face 112 may comprise a blunt surface while a lower portion may comprise a sharp edge. Additionally or alternatively, a lower portion may comprise a blunt edge while a top portion may comprise a blunt surface.

In the illustrative environment shown in FIG. 1, the head 102 comprises a pick 114. The pick 114 may be used as an anchor point, a striking surface, a prying tool, and any other useful purpose. For example, the pick may be used as a striking tool to gain access to a particular room or building. For another example, the pick may be used as an anchor point. In such an example, a user (e.g., a firefighter) on a roof may embed the pick into the roof. Once embedded, the firefighter may stand on the top of the head, using the multi-use ax as a step. The firefighter may also embed the pick into the roof and hook into a belay loop at a distal end of a handle of the multi-use ax. In such an example, the firefighter may rappel off the roof to safety.

In various embodiments, the pick 114 may be oriented substantially along the horizontal axis 108 of the multi-use ax 100. In the illustrative embodiment shown in FIG. 1, the pick 114 may be oriented at an angle from the horizontal axis 108 of the multi-use ax 100. The angled pick may provide multiple benefits, such as, for example, increased leverage for prying and enhanced anchor setting. In various embodiments, the pick 114 may be angled between 5 and 45 degrees from the horizontal axis 108. In at least one embodiment, the pick 114 may be angled 10 degrees from the horizontal axis 108.

In various embodiments, the pick 114 may be tapered in width and/or height from a base to a tip. In various embodiments, the pick 114 may be substantially the same width and/or height for a majority of the pick (i.e., greater than 50% of the pick length). In at least one embodiment, the pick 114 may be the same width and/or height from the base to approximately 1 inch from the tip. The continuous dimension in the pick may allow for a more solid set into a striking surface. For example, a firefighter striking a roof may be able to better set the pick of the multi-use ax into the roof, thereby reducing undesirable movement, such as wobbling. The firefighter may thus be more confident in the multi-use ax holding steady, providing a more solid foot hold for the firefighter to climb and/or work on the roof.

In some embodiments, at least part of the top surface 116 may comprise a traction feature (non-slip surface) (e.g., surface texture (e.g., knurling, indentations, raised features, or combinations thereof), rubber, plastic, etc., or combinations thereof) to prevent an object from sliding off. In such embodiments, the non-slip surface on the top surface 116 may provide traction and further increase a user's safety when using the multi-use ax as a step or foot-hold. In the illustrative embodiment, part of the top surface 116 comprises a knurling pattern.

In various embodiments, the top surface 116 may comprise a cutout 120, centered on the top surface 116. In some embodiments, the cutout 120 may be used as a gas and/or water shutoff, providing the ability to open and close a gas and/or water valve. In the illustrative embodiment, the cutout 120 is substantially rectangular. The rectangular shape shown in FIG. 1 may be capable of fitting a majority of gas and/or water valves in use today. In at least one embodiment, the cutout 120 may be 1¼ inches long (i.e., along the horizontal axis 108), ½ inch wide, and ⅜ inch deep. However, it is understood that the cutout 120 may comprise a different size and/or shape as appropriate to fit other gas and/or water shutoff valves.

In various embodiments, the head 102 comprises a hole 122 going through the width of the head. In such embodiments, the hole 122 may be designed to receive the another tool, such as, for example, a Halligan style pry tool, thereby allowing the two tools to be easily carried together. In some embodiments, the hole 122 comprises a substantially rectangular shape, and is 2¼ inches long (i.e., along the horizontal axis 108) and ¾ inch wide. In yet another embodiments, the hole 122 comprises a substantially rectangular shape, and is 3⅛ inches long and ¾ inch wide. Though the hole 122 may be designed to receive another tool, the hole 122 may additionally be used for other purposes, such as, for example, water and/or gas shutoff, a belay loop, and a handle, to name a few.

In some embodiments, the head 102 may comprise an anchor notch 118. In such embodiments, the anchor notch 118 may provide an anchor point for a belay. For example, the anchor notch may be secured (e.g., hooked) around on a window ledge or window sill, creating a stable anchor point for belay. In yet another example, the anchor notch may be secured around a pipe, creating a stable anchor point.

In various embodiments, the anchor notch 118 may an angled side, configured to assist in pulling the tool tight against the surface to increase stability and security of the anchor point. In some embodiments, the angled side of the anchor notch 118 may also provide a breaching surface. In such embodiments, the bottom of the notch may come to a point, and may allow for penetration into a surface to increase stability of the anchor point. In various embodiments, the anchor notch 118 may comprise a non-slip surface or traction feature, such as, for example, a rubber coating or knurling. In such embodiments, the non-slip surface may increase the stability of the anchor point.

In the illustrative embodiment, the anchor notch 118 is located on the beard (i.e., the underside of the ax face, or the front of the head). In some embodiments, the anchor notch 118 may be located on the underside of the pick 114. In still yet other embodiments, the head 102 may comprise two anchor notches 118, one on the beard, and one on the pick. In such embodiments, the anchor notches 118 may be different sizes, thereby providing options for a user to have a better fit, and thus more stable, anchor point.

As depicted in FIG. 1, the multi-use ax comprises a handle 104, running substantially along the vertical axis 110 of the multi-use ax 100. The handle 104 may comprise a proximal end, closest to the head 102, and a distal end. In some embodiments, the handle 104 may be a straight handle, oriented along the vertical axis 110. In the illustrative embodiment, the handle 104 is ergonomically shaped, with curves on either side to provide optimal performance and comfort for the user. In some embodiments, the handle 104 may comprise additional ergonomic features, such as, for example, rounded edges, gripping surfaces (e.g., a rubber coating, a plastic coating, a textured surface, etc.), and a grip notch (i.e., to assist the gripping hand from slipping off the distal end of the handle).

The handle 104 may be attached to the head 102 at attachment point 106. The attachment point 106 may comprise a tendon and mortise, a press fit, a weld, or any other reasonable way to attach a head 102 to a handle 104. The attachment point 106 will be discussed in further detail below.

The handle 104 of the multi-use ax 100 may comprise a metal material, a plastic material (e.g., high-density polyethylene, acrylic, melamine, polycarbonate, etc.), a composite material (e.g., fiberglass, carbon fiber, etc.), a wood material, and combinations of the foregoing, among others. In at least one embodiment, the handle comprises grade 7075 aluminum.

In various embodiments, the handle 104 may comprise a series of relief cuts 124 in which material has been removed. The relief cuts 124 may decrease the weight of the handle, assist with balance, may increase the efficiency of a grip, to name but a few possible advantages. In at least one embodiment, the relief cuts 124 may be chamfered over to ensure there are no sharp edges.

In various embodiments, the handle 104 may comprise at least one wrench hole 126. In the illustrative embodiment, the handle 104 comprises two wrench holes 126, located in the relief cut 124 closest to the proximal end of the handle 104. In such an embodiment, a user may be able to apply a maximum amount of torque from the distal end of the handle 104. In some embodiments, the wrench hole(s) 126 may be located at a mid-point of the handle 104. In such embodiments, the user may be able to impart a force at the head 102 and the distal end of the handle 104, thereby increasing the torqueing force applied to the bolt. In other embodiments, the wrench holes 126 may be located at other locations on the handle 104.

In various embodiments, the wrench holes 126 may be sized and shaped to fit fire hydrant bolts. In such embodiments, the wrench holes 126 may be a pentagonal shape, a square shape, a hexagonal shape, an octagonal shape, or any other shape used for fire hydrant bolts. In at least one embodiment, the handle 104 may comprise two wrench holes 126, one being pentagonal and sized to fit a 1½ inch pentagonal fire hydrant operating nut, and one being square and sized to fit a 1¼ inch square fire hydrant operating nut.

In various embodiments, handle 104 may comprise a slot for webbing, oriented substantially along the vertical axis of the multi-use ax 100. In such an embodiment, the webbing may be run through the slot, and may secure additional gear and/or tools to the multi-use ax 100. For example, the webbing may secure a Halligan style pry bar to the multi-use ax, the pry end of the Halligan style pry bar being secured in the hole 122 in the head 102. In some embodiments, the slot may be located in a relief cutout 124.

In various embodiments, the multi-use ax 100 may comprise a belay loop 128 at the distal end of the handle 104. In the illustrative embodiment, the belay loop 128 is an unbroken loop of metal. In some embodiments, the belay loop 128 may comprise a carabiner with a gate. In such embodiments, the carabiner may be an automatic or manual locking carabiner, in order to increase the strength of the belay loop 128. Various embodiments contemplate that the belay loop 128 may be substantially integrated into the handle 104. For example, the handle 104 may comprise a grip section of the handle for gripping by a user. Various embodiments contemplate that the belay loop is located within a portion of the grip section. Additionally or alternatively various embodiments contemplate that the belay loop is located directly adjacent to a portion of the grip section. Additionally or alternatively, various embodiments contemplate that the belay loop is located in a substantially smooth extension of the handle past the grip section.

Various possible benefits of these locations of the belay loop may include sufficient strength in the belay loop 128 to support a user during an aggressive descent. Additionally or alternatively, the belay loop 128 may be integrated into the handle allowing an additional extension or feature to be added to the end of the handle 104 past the grip section. Additionally or alternatively, the belay loop 128 location may allow for use of the tool for other purposes without interference of the belay loop 128.

Figure 2:
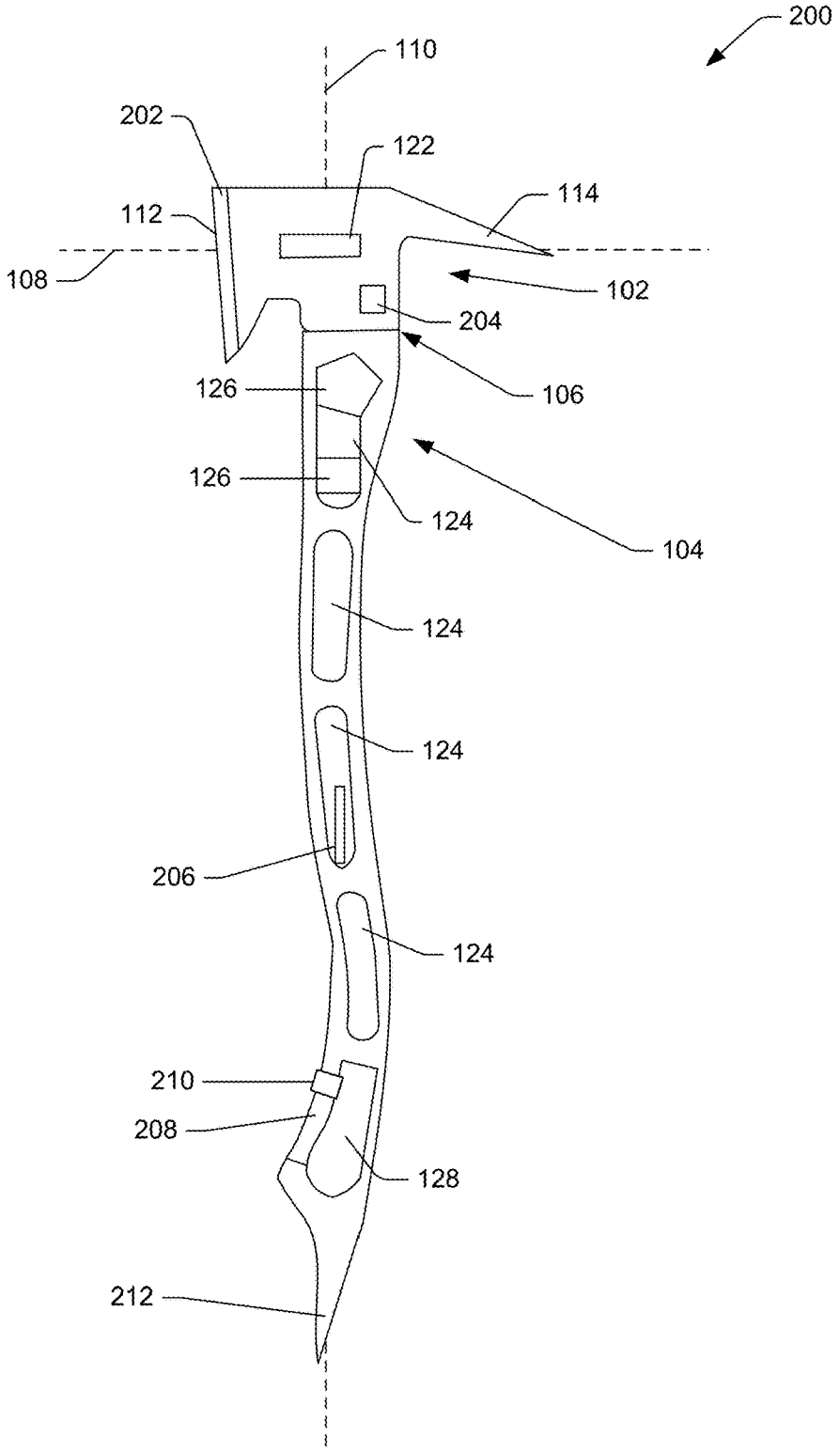
FIG. 2 is a side view of a multi-use ax with an anchor point at a distal end of the handle.

FIG. 2 is an isometric view of a multi-use ax, such as multi-use ax 100. Multi-use ax 200 comprises a head 102, a handle 104, and an attachment point 106.

As discussed above in reference to FIG. 2, the head 102 may comprise a pick 114 and an ax face 112. In various embodiments, the ax face 112 may be oriented parallel to a vertical axis 110. As depicted in FIG. 2, the ax face 112 may be oriented at an angle from the vertical axis 110. In some embodiments, the ax face 112 may be oriented at an angle between 5 and 45 degrees from the vertical axis 110. In at least one embodiment, the ax face 112 may be oriented at a 5 degree angle from the vertical axis 110

In various embodiments, the ax face 112 may comprise a blunt surface centered between beveled edges 202. In some embodiments, the beveled edges 202 may be oriented at angle between 15 and 85 degrees from the flat surface. In at least one embodiment, the beveled edges 202 are oriented at a 45 degree angle from the blunt surface. In other embodiments, the ax face 112 may comprise a sharp edge.

In the illustrative embodiment, the head 102 may comprise a hole 122 and/or an additional hole 204. In such embodiments, the hole 122 and/or the additional hole 204 may be configured to house an additional tool, such as one to supplement the multi-use ax 200. For example, the hole 122 and/or additional hole 204 may be configured to house a Halligan pry tool. The Halligan pry tool, together with the multi-use ax 200 striking tool, may create a set of "irons" used in forcible entry evolutions.

In various embodiments, the hole 122 and/or the additional hole 204 may be configured to be used as a shutoff, such as for a water and/or gas shutoff valve. In some embodiments, the hole 122 and/or the additional hole 204 may be configured to be used as a wrench.

In various embodiments, the pick 114 may be oriented substantially along the horizontal axis 108. In the illustrative embodiment, the pick 114 is oriented at an angle from the horizontal axis 108. The angle may comprise any angle between 5 and 45 degrees from the horizontal axis. In at least one embodiment, the pick 114 is configured 10 degrees from the horizontal axis.

In various embodiments, the pick 114 may be substantially the same width and/or height throughout a majority of the pick 114. In some embodiments, the pick 114 may be tapered in width and/or height from a base to a tip. In the illustrative embodiment, the pick 114 comprises a consistently tapered height, with each of the top and bottom sides angled to meet at a tip. In some embodiments, the pick 114 may comprise an inconsistent taper. In such embodiments, the top and the bottom sides may extend in a root section at one angle, and increase in angle at a tip section. In at least one embodiment, the pick 114 may be comprise a root section, with a consistent height, and a tip section in which the top and the bottom surfaces are angled to meet at a tip.

The head 102 of the multi-use ax 200 may be secured to a proximal end of a handle 104 at attachment point 106. As discussed above with reference to FIG. 1, the handle 104 may comprise relief cuts 124, wrench holes 126, and a belay loop 128.

In the illustrative embodiment, the handle 104 comprises four substantially ovular relief cuts 124. However, the handle 104 may comprise greater or fewer number of relief cuts 124. Additionally, the relief cuts 124 may be substantially circular, square, rectangular, or any other shape.

As depicted in FIG. 2, the handle may comprise one or more wrench holes 126. In some embodiments, the wrench holes may be sized and shaped to fit fire hydrant bolts. In such embodiments, the wrench holes 126 may be pentagonal and/or square. In at least one embodiment, the handle 104 comprises two wrench holes 126, one sized to fit a 1½ inch pentagonal fire hydrant operating nut, and one being square and sized to fit a 1¼ inch square fire hydrant operating nut. In some embodiments, the wrench holes 126 may be sized and shaped to fit other bolts.

In various embodiments, the handle 104 may comprise a slot 206 for securing additional equipment to the multi-use ax 200, such as, for example, with webbing. In the illustrative embodiment, slot 206 is a rectangular shaped slot, configured substantially parallel to the vertical axis 110. In some embodiments, the slot 206 may be ovular, circular, square, or any other shape. In various embodiments, the slot 206 may comprise a length and width capable of housing webbing, rope, twine, parachute cord, or any other material used for securing equipment.

In various embodiments, the handle 104 may comprise a belay loop 128. In some embodiments, the belay loop 128 is configured at the distal end of the multi-use ax 200. In some embodiments, the belay loop may comprise a carabiner 208 (e.g., an auto-locking carabiner, a manual lock carabiner, a non-locking carabiner). In such an embodiment, a user may be able to place a rope in the belay loop quicker and easier than feeding it in. For example, the gate of the carabiner may be opened, providing access to the belay loop, such that a rope could be placed inside of the belay loop at a mid-point of the rope (i.e., any point other than an end of the rope). In at least one embodiment, the carabiner 208 is capable of withstanding a force of at least 13 kN.

In the illustrative embodiment, the carabiner 208 comprises a lock 210. A benefit to having a lock 210 on the carabiner 208 is that the lock 210 increases the strength of the belay loop 128 (when the gate is closed) as compared to a non-locking carabiner.

As depicted in FIG. 2, the handle 104 of the multi-use ax 200 may comprise a spike 212. In such embodiments, the distal end of the handle 104 may come down to a tip, thereby providing a stable third point of contact while walking on a firm and/or slanted surface such as/for example, a roof Additionally or alternatively, when penetrated into a surface, the spike 122 may provide for an additional anchor point.

Figure 3:
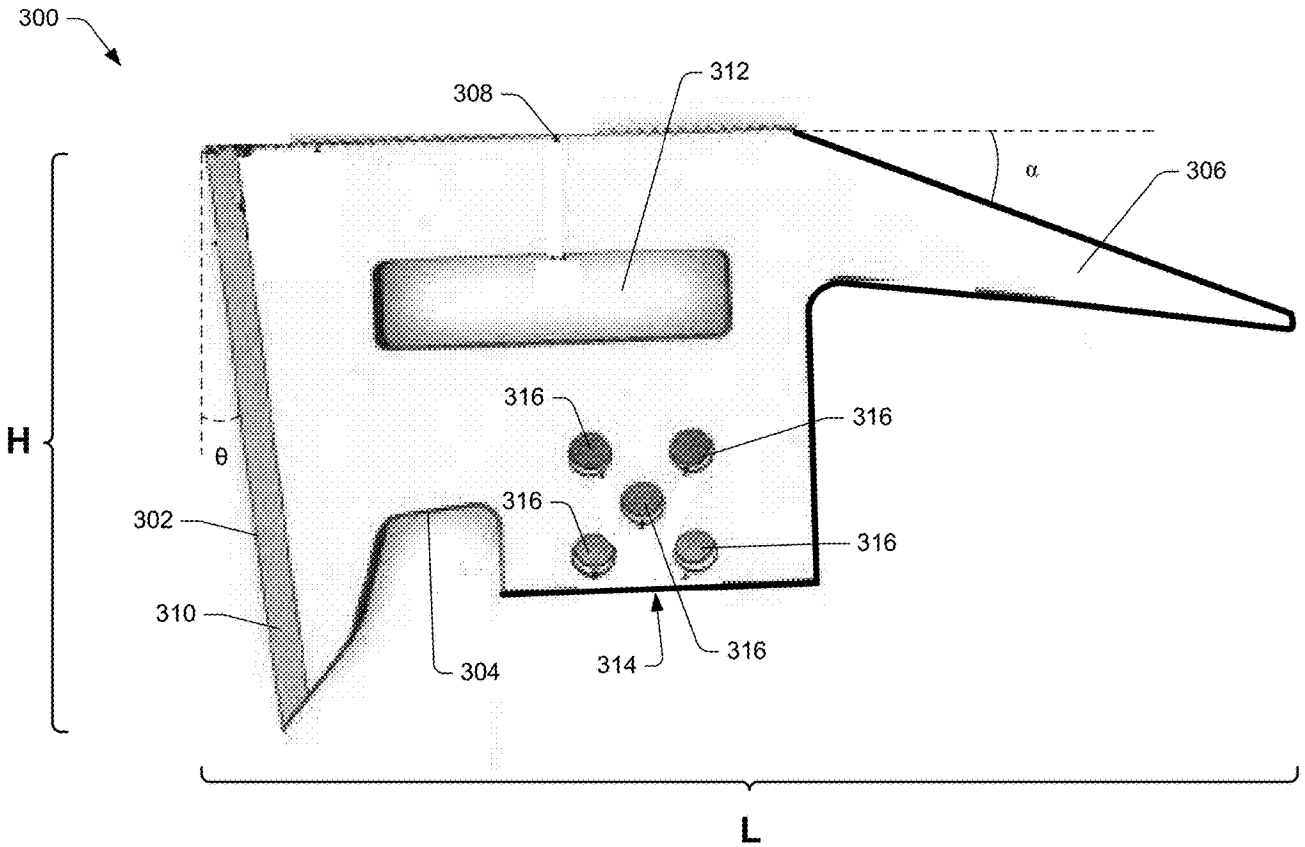
FIG. 3 is a side view of a head of a multi-use ax.

FIG. 3 is an isometric view of a head of a multi-use ax, such as multi-use ax 100. In various embodiments, the head 300 may comprise a metal material. In at least one embodiment, the head 300 comprises a solid piece of steel, hardened to 455-55 on the Rockwell hardness scale.

In various embodiments, the head 300 may comprise a length, L of 12 inches or less. In at least one embodiment, the head 300 may comprise a length, L of 10 inches. In some embodiments, the head 300 may comprise a length of greater than 12 inches. In various embodiments, the head 300 may comprise a height, H of 6 inches or less. In some embodiments, the head 300 may comprise a height, H of greater than 6 inches.

As shown in FIG. 3, the head 300 may comprise an ax face 302, an anchor notch 304, a pick 306, and a top surface 308.

In various embodiments, the ax face 302 may comprise a sharp blade. In the illustrative embodiment, the ax face 302 comprises a blunt surface, flanked by beveled edges 310. In some embodiments, the beveled edges 310 may be angled away from the blunt surface, at a 45 degree angle.

In various embodiments, the ax face 302 may be oriented substantially parallel to a vertical axis of the multi-use ax. In some embodiments, the ax face 302 may be oriented at an angle $\theta$, from the vertical axis. In some embodiments, the angle $\theta$ may be an angle between 5 and 45 degrees. In at least one embodiment, angle $\theta$ may be about 5 degrees.

As depicted in FIG. 3, the ax face 302 may extend from the top surface 308 to a bottom surface. In various embodiments, the underside, of the ax face 302 (i.e. the beard) may be substantially perpendicular to the ax face 302. In some embodiments, the beard of the ax face 302 may comprise a tip, extending away from the ax face 302 at an angle. In such embodiments, the beard of the ax face 302 may comprise an anchor notch 304.

In various embodiments, the anchor notch 304 may be used as an anchor point, by securing the anchor notch 304 in a given material so it will not release or slip when weight is applied to the handle. In such embodiments, the angle on the beard side of the anchor notch 304 may be designed to pull the tool tight against the anchoring surface in order to create a stable and secure anchor point. For example, the anchor notch may be secured on the ledge of a window sill, with the handle oriented out the window. Once secured, a user may hook into a belay loop on the multi-use ax handle, and rappel out the window to safety.

Additionally or alternatively, the beard side of the anchor notch 304 may be used as an additional striking and/or breaching surface. For example, the sharp point combined with the angle of the anchor notch may be helpful in removing and breaching drywall or any other material. Once the anchor notch has breached the surface of a given material, the angle of the anchor notch may provide an efficient way to pull and remove the given material.

In some embodiments, the head 300 of the multi-use ax may comprise a pick. In various embodiments, the pick 306 may be oriented substantially along the horizontal axis of the head 300. In the illustrative embodiment shown in FIG. 3, the pick 306 may be oriented at an angle $\alpha$ from the horizontal axis of the multi-use ax 300. The angled pick may provide multiple benefits, such as, for example, increased leverage for prying and enhanced anchor setting. In various embodiments, angle $\alpha$ may be between 5 and 45 degrees. In at least one embodiment, the angle $\alpha$ may be 10 degrees.

In various embodiments, the pick 306 may be tapered in width and/or height from a base to a tip. In various embodiments, the pick 306 may be substantially the same width and/or height for a majority of the pick (i.e., greater than 50% of the pick length). In at least one embodiment, the pick 306 may be the same width and/or height from the base to approximately 1 inch from the tip. The continuous dimension in the pick may allow for a more solid set into a striking surface. For example, a firefighter striking a roof may be able to better set the pick of the multi-use ax into the roof, thereby reducing undesirable movement, such as wobbling. The firefighter may thus be more confident in the multi-use ax holding steady, providing a more solid foot hold for the firefighter to climb and/or work on the roof In various embodiments, the base of the pick 306 may extend into a top surface 308. In some embodiments, at least part of the top surface 308 may comprise a non-slip surface or traction feature to provide extra friction for anything that comes into contact with the top surface 308. In such embodiments, the non-slip surface on the top surface 308 may provide traction and further increase a user's safety when using the multi-use ax as a step or foot-hold. In the illustrative embodiment, part of the top surface 308 comprises a knurling pattern.

In various embodiments, the top surface 308 may comprise a cutout, centered on the top surface 308. In some embodiments, the cutout may be used as a gas and/or water shutoff, providing the ability to open and close a gas and/or water valve. The cutout may be substantially rectangular, ovular, square, or any other shape capable of fitting a number of gas and/or water valves. In some embodiments, the cutout may be rectangular. In such an embodiment, the cutout may be capable of fitting a majority of gas and/or water valves in use today. In at least one embodiment, the cutout may be rectangular, and 1¼ inches long, ½ inch wide, and ⅜ inch deep.

In various embodiments, the head 300 may comprise at least one hole 312, extending though the width of the head 300. In some embodiments, the hole 312 may be designed to receive and secure another tool, such as, for example, a Halligan style pry tool, thereby providing a means by which two tools may be easily carried together. Additionally or alternatively, the hole 312 may be designed as a belay loop, thereby providing a user with yet another means by which they may anchor into the multi-use ax.

In the illustrative embodiment, head 300 comprises a single hole 312, the single hole comprising a substantially rectangular shape. However, in some embodiments, the head 300 may comprise more than one hole 312, each of the holes 312 comprising the same or a different shape, such as a circle, an oval, a square, and the like. For example, as depicted in FIG. 2, the head comprises two holes, one being rectangular, and the other being square.

In the illustrative embodiment shown in FIG. 3, the head 300 comprises a mortise 314. In various embodiments, the mortise 314 may be cast and machined out of the head 300. In some embodiments, the mortise 314 may be cast in place, thereby providing additional strength at an attachment point with the handle.

In various embodiments, the mortise 314 may be designed to receive a tenon of a handle. In such embodiments, the tenon of the handle may snuggly fit into the mortise 314, and may be further secured by roll pins (e.g., stainless steel, titanium, aluminum, etc.) placed through roll pin holes 316. In at least one embodiment, the mortise 314 is 2 inches long, ⅗ inches wide, and 1½ inches deep. In at least one embodiment, the roll pin holes 316 may be sized to fit 0.375 inch roll pins.

As shown in FIG. 3, the head 300 may comprise 5 roll pin holes 316. However, other embodiments may comprise a greater or lesser number of roll pin holes 316. In various embodiments, the roll pin holes 316 may be machined out of the head 300. In some embodiments, the roll pin holes 316 may be created by a mold, such as, for example, in an injection mold. In embodiments in which roll pins are further used to secure the handle to the head, roll pin holes may be machined into a proximal end of the handle.

Figure 4A:
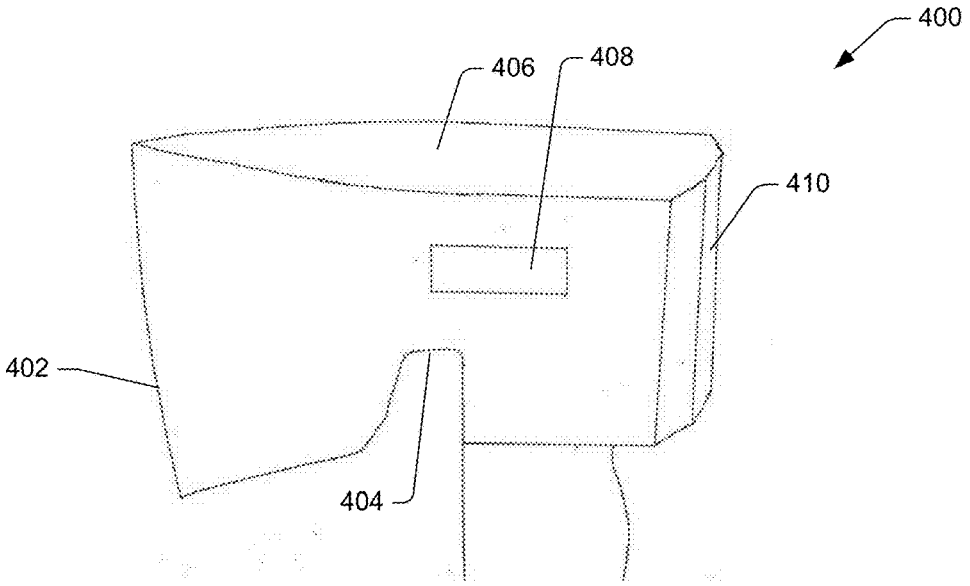
FIGS. 4A and 4B are isometric views of a head of a multi-use ax.
Figure 4B:
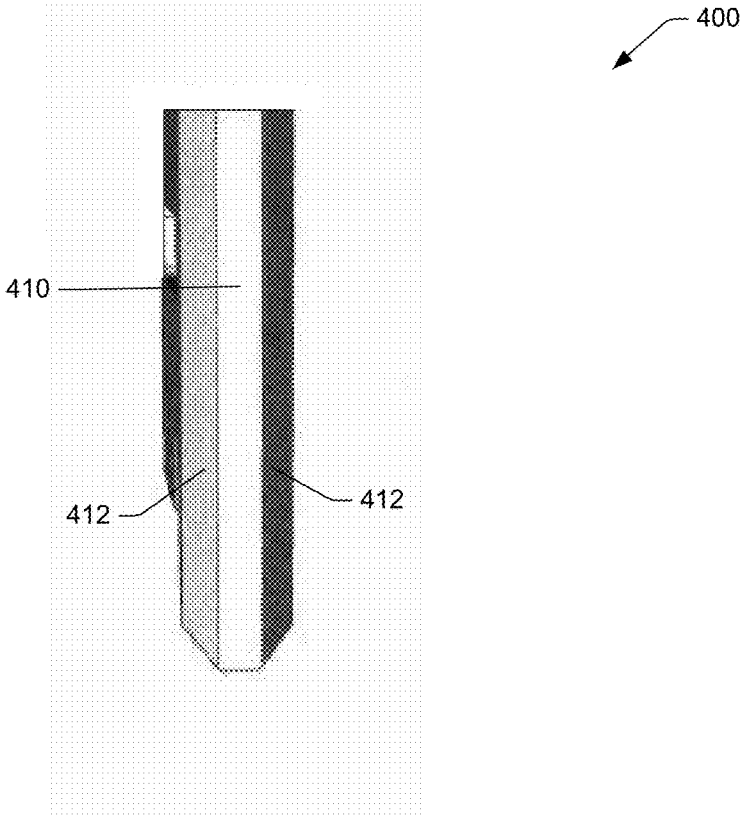

FIGS. 4A and 4B are isometric views of a head of a multi-use ax. FIG. 4A depicts a side view of the head. FIG. 4B depicts a back view of the multi-use ax head depicted in FIG. 4A.

As depicted in FIG. 4A, the head of a multi-use ax may comprise an ax face 402, an anchor notch 404, a top surface 406, a hole 408, and a blunt surface 410. In various embodiments, the ax face 402 may be a sharp edge. In such embodiments, the ax face 402 may be used for penetrating various surfaces. The ax face 402 may be oriented parallel to, or at an angle from, the vertical axis.

In various embodiments, the head 400 may comprise an anchor notch 404 on the underside of the ax face 402. In the embodiment shown in FIG. 4, the anchor notch 404 may be situated proximate to an attachment point of a handle of the multi-use ax. In such embodiments, the anchor notch 404 may provide increased stability when secured around a ledge or similar structure.

As depicted in FIG. 4A, the head 400 may comprise a substantially flat top surface 406. In various embodiments, the top surface 406 may comprise a smooth surface. In some embodiments, the top surface 406 may comprise a non-slip surface or traction feature, such as, for example, a knurling or a rubber coating. In such examples, the non-slip surface may provide additional friction to assist a user in securing a grip or hold on the top surface 406. For example, if the ax face gets wedged into a material, a non-slip surface may be beneficial to assist a user in applying consistent pressure to free the ax face.

In various embodiments, head 400 may comprise a hole 408. In various embodiments, the hole 408 may be configured to act as a gas and/or water shut-off. In such embodiments, the hole 408 may be sized to fit various valves. For example, a first section of the hole may be cut at a particular size and/or shape to fit a valve, while a second section of the hole is cut to a different size and/or shape to fit a different valve. Additionally or alternatively, the hole 408 may be configured to house another tool, such as, for example, a prying tool.

In the illustrative embodiment, a back side of the head 400 comprises a blunt surface 410. The blunt surface 410 may comprise a flat striking surface. In various embodiments, the blunt surface 410 the blunt surface 410 may be flanked by beveled edges.

FIG. 4B illustrates a front view of the blunt surface 410 flanked by beveled edges 412. In such an embodiment, the beveled edges 412 may assist in preventing the blunt surface from getting pinched or wedged into a material upon striking. The beveled edges 412 may be angled between 15 and 85 degrees from the blunt surface 410. In at least one embodiment, the beveled edges 412 are oriented at a 45 degree angle from the blunt surface 410.

In some embodiments, the blunt surface 410 may be oriented substantially parallel to a vertical axis of the multi-use ax. In some embodiments, the blunt surface 410 may be oriented at an angle.

Figure 5:
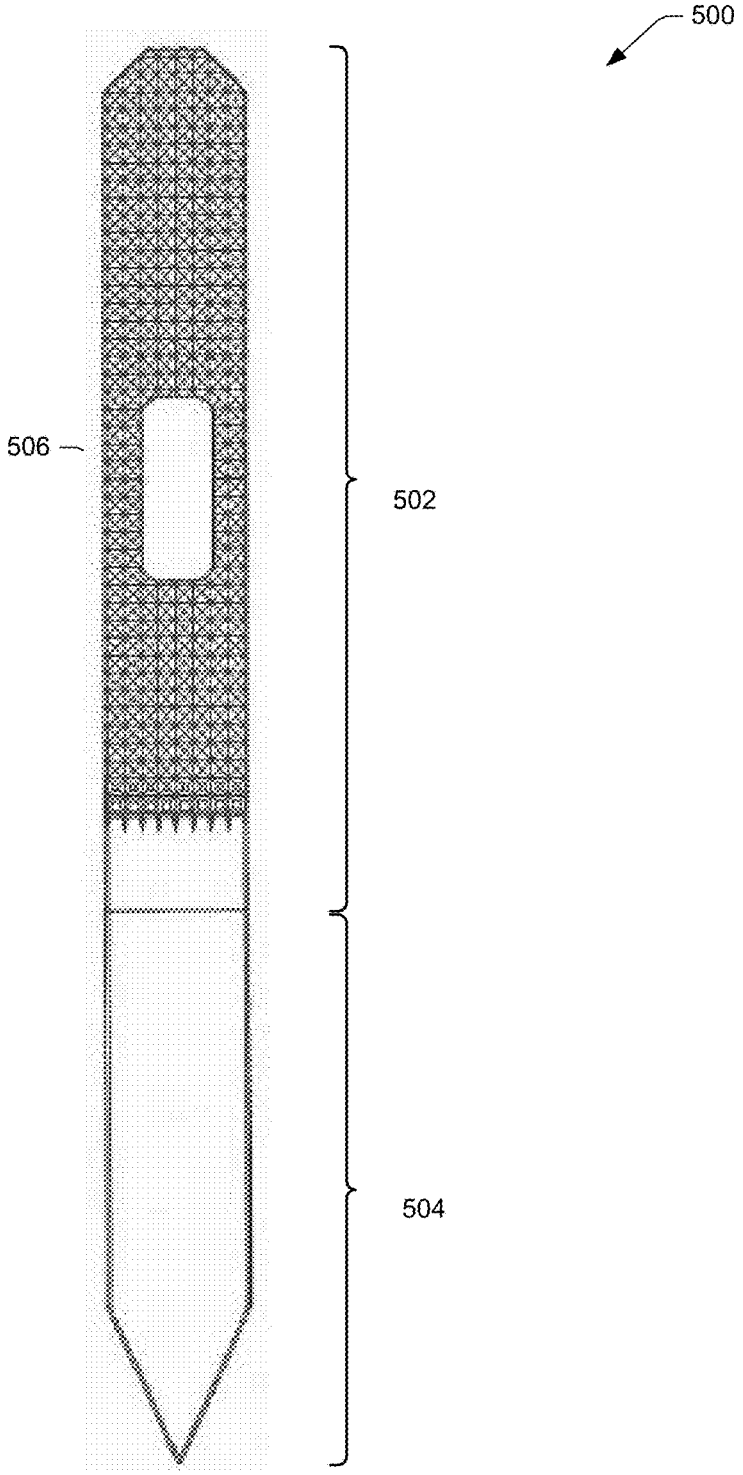
FIG. 5 is a top view of a head of a multi-use ax.

FIG. 5 is a top view of a head of a multi-use ax, such as multi-use ax 100. The top of head 500 may comprise a top surface 502, such as top surface 116, and a tip section 504.

In various embodiments, the top surface 502 may comprise a non-slip surface. As illustrated in FIG. 5, the non-slip surface comprises a knurling. However, it is understood that the non-slip surface may comprise a rubber coating, a plastic coating, an anti-slip tape, a grip tape, or any other material and/or machining process that may increase friction on a surface. In some embodiments, the non-slip surface may additionally extend along the tip section 504.

In various embodiments, the top surface 502 may comprise a cutout 506, configured to act as a gas and/or water shutoff. In the illustrative embodiment, the cutout 506 is substantially rectangular in shape. In at least one embodiment, the cutout 506 is configured as a gas shutoff, and is sized 1¼ inches long, ½ inch wide, and ⅜ inch deep. However, it is understood that the cutout 506 may comprise a different shape and/or size, as appropriate to fit other gas and/or water shutoff valves.

Figure 6:
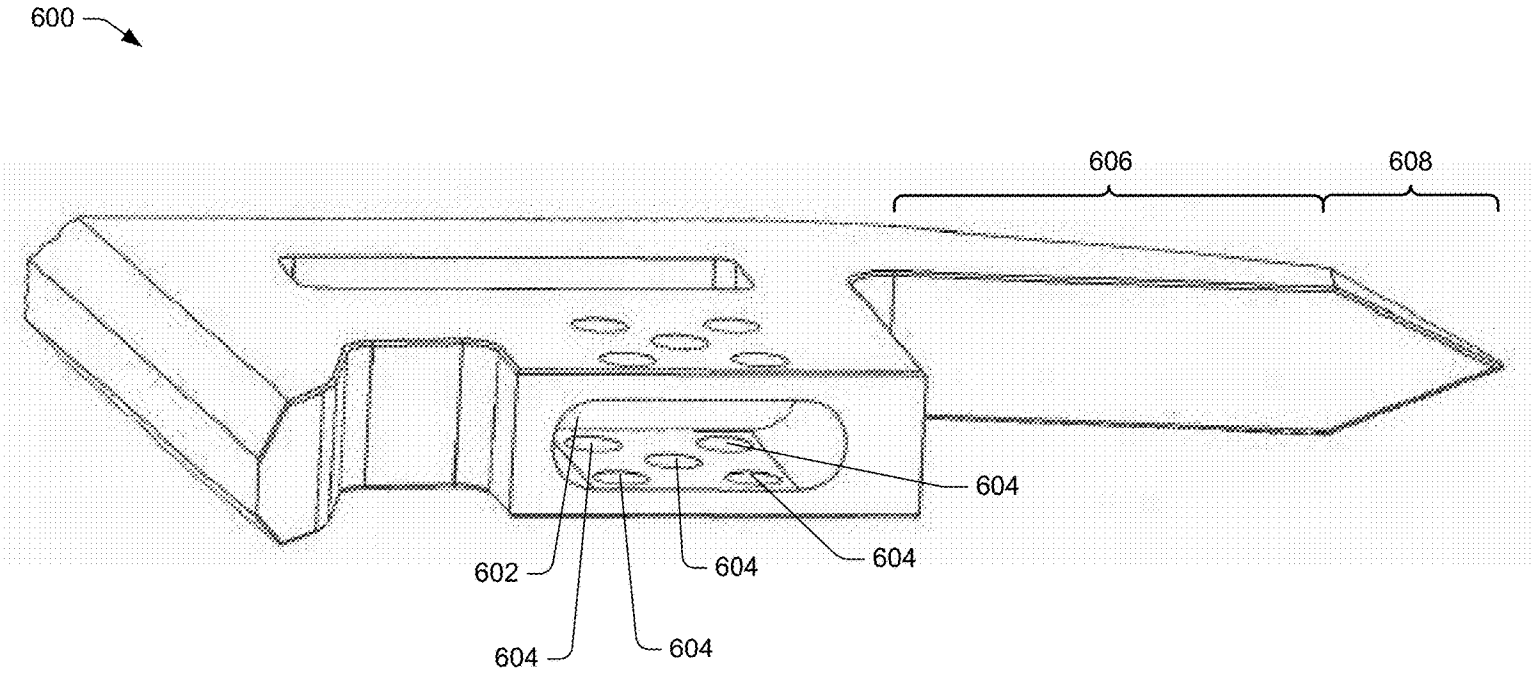
FIG. 6 is a bottom view of a head of a multi-use ax.

FIG. 6 is a bottom view of a head of a multi-use ax. In various embodiments, the head 600, such as head 100, may comprise a mortise 602. In such embodiments, the mortise 602 may be configured to house a tenon of a handle. The mortise 602 may be cast and machined out of the head or cast in place. In some embodiments, head 600 and/or the mortise 602 may be heat treated, such as, for example by annealing.

In various embodiments, the mortise 602 and the tenon of the handle may be hydraulically pressed together to secure the head 600 to the handle. In some embodiments, the connection may be further secured by roll pins placed through machined roll pin holes 604. Thus, the connection between the head 600 and the handle may be capable of withstanding very large forces. For example, when the pick is used to pry a material away from a surface, a large force may be imparted on the connection.

In such an example, a large force may also be imparted upon the pick at both a root section 606 and a tip section 608. As illustrated in FIG. 6, the root section 606 of the pick may be substantially the same width, thereby increasing the ability of the pick to withstand large forces. In various embodiments, the root section 606 may be substantially the same height. In some embodiments, the root section 606 may be tapered in height and/or width.

The tip section 608 may be tapered to a tip of the pick. In the illustrative embodiment, the tip comprises a sharp point. In other embodiments, the tip may comprise a flat surface. In such embodiments, the effectiveness of the pick as a pry tool may be increased.

Figure 7:
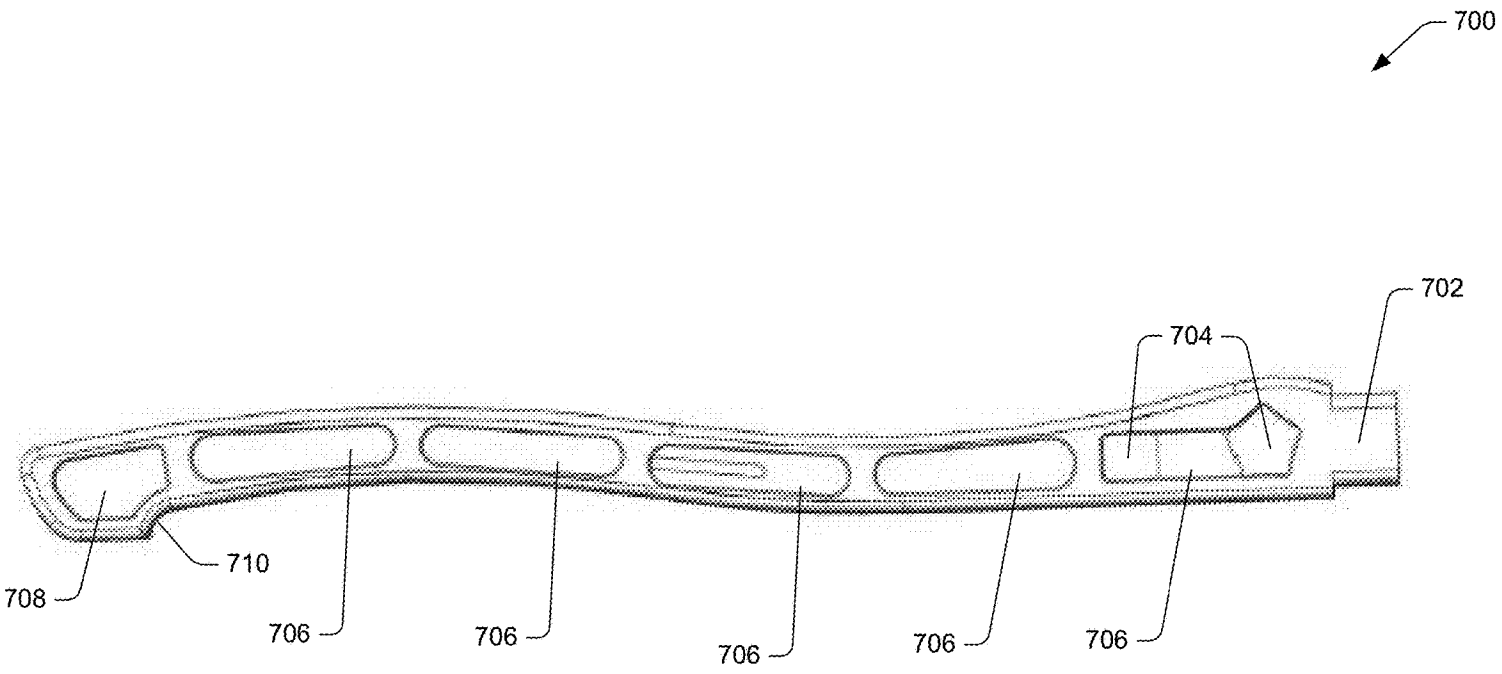
FIG. 7 is a side view of a handle of a multi-use ax.

FIG. 7 is a side view of a handle of a multi-use ax, such as multi-use ax 100. The handle 700 may comprise a metal material, a wood material, a composite material, or any combination of the foregoing. In various embodiments, the handle 700 may comprise a solid piece of metal. In some embodiments, the handle 700 may comprise a rib, such as, for example, a steel rib, running at least part of the length of the handle 700 from a proximal end to a distal end, to provide strength. In such an embodiment, the rib may be covered by a composite coating, thereby making up the remainder of the shape of the handle 700.

In the illustrative embodiment, the edges of the handle 700 are rounded to make the handle more ergonomic, and to increase gripping capabilities. In at least one embodiment, the edges may be rounded over with a ¼ inch radius. In other embodiments, the edges of the handle 700 may be squared off. In still yet other embodiments, some of the edges of the handle may be squared off, while others are rounded.

In various embodiments, the handle 700 may comprise a tenon 702, wrench holes 704, relief cuts 706, a belay loop 708, and a finger notch 710. In some embodiments, the handle may additionally comprise a tip at the distal end. The tip may be used as a spike, a pry tool, an anchor point, or for any other useful purpose. In some embodiments, the tip may be oriented substantially parallel with an axis of the handle. In other embodiments, the tip may be oriented at an angle from the axis of the handle.

As discussed above with respect to FIG. 6, in various embodiments, the handle 700 may be connected to a head via tenon and mortise joint. In such embodiments, the handle 700 may comprise a tenon at the proximal end, which may be hydraulically pressed into the mortise for a secure fitting. In some embodiments, the tenon may be further secured with roll pins. In such embodiments, tenon may have machined roll pin holes, similar to roll pin holes 604 in head 600.

As illustrated in FIG. 7, the tenon 702 may be less wide than the handle surface that abuts the head. In various embodiments, the handle 700 may be substantially at its widest point in the section that abuts the head, thus providing increased strength at or near the connection point. Additionally, the handle 700 may be wide in the section that abuts the head in order to support torsional forces applied via one or more wrench holes 704.

In various embodiments, the one or more wrench holes 704 may be sized and shaped to fit fire hydrant bolts. In such embodiments, the wrench holes 704 may be a pentagonal shape, a square shape, a hexagonal shape, an octagonal shape, or any other shape used for fire hydrant bolts. In at least one embodiment, the handle 700 may comprise two wrench holes 704, one being pentagonal and sized to fit a 1½ inch pentagonal fire hydrant operating nut, and one being square and sized to fit a 1¼ inch square fire hydrant operating nut. In the illustrative embodiment, wrench holes 704 are cut into a relief cut 706. In other embodiments, however, the wrench holes 704 may be independent of the relief cuts 706.

In some embodiments, the handle 700 may comprise relief cuts 706. The relief cuts 706 may reduce the weight of the handle. In the illustrative embodiment, the handle 700 comprises 5 relief cuts 706. However, the handle 700 may comprise a greater or fewer number of relief cuts 706. Additionally, in the illustrative embodiment, the relief cuts are substantially ovular in shape. However, it is understood that the relief cuts may comprise another shape, such as a circle, a square, a hexagon, a pentagon, an octagon, etc.

In various embodiments, the multi-use ax may comprise features to assist with gripping, such as, for example, grip notch 710. The grip notch 710 may be configured to support a gripping hand (i.e., by resting the end of a grip hand, such as a pinky finger, in the notch), and keep the hand from slipping while operating the ax in a swinging motion. The grip notch 710 may also decrease the grip strength needed to hold the multi-use ax, such as, for example, while walking with the multi-use ax with the head facing down. In some embodiments, the handle may also include a non-slip surface in the grip notch 710 and/or the opposite side of the handle at the grip. In some embodiments, the handle 700 may comprise a knurled or notched surface to increase the friction at the grip.

In various embodiments, the multi-use ax may comprise a belay loop 708 at the distal end of the handle 700. In the illustrative embodiment, the belay loop 708 is an unbroken loop. In some embodiments, the belay loop 708 may comprise a carabiner with a gate. In such embodiments, the carabiner may be an automatic or manual locking carabiner, in order to increase the strength of the belay loop 708.

Figure 8:
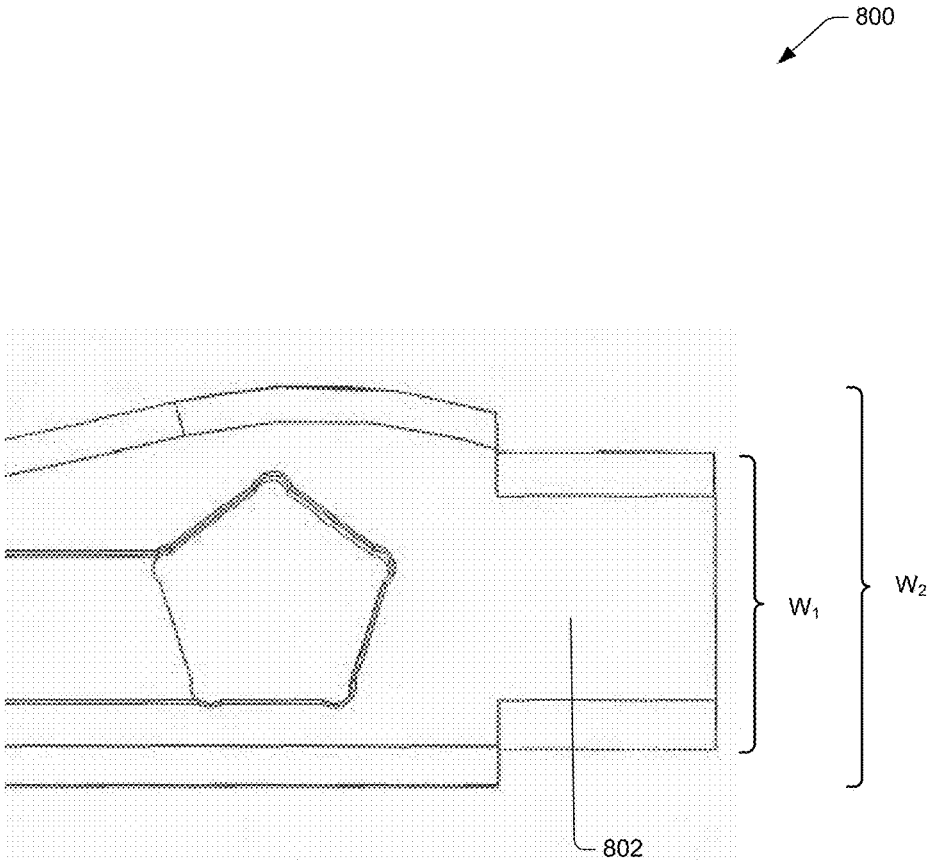
FIG. 8 is side view of a tenon of a handle of a multi-use ax.

FIG. 8 is side view of a tenon of a handle of a multi-use ax, such as multi-use ax 100. As discussed above with regard to FIG. 6, the handle may comprise a tenon 802 at a proximal end. The tenon 802 may be hydraulically pressed to a mortise in a head, thereby ensuring a secure connection between the head and the handle.

In some embodiments, the width of the tenon $W_1$, may be equal to or greater than width of the section of the handle that abuts the head $W_2$. In the illustrative embodiment, $W_1$ is less than $W_2$. In such embodiments, the excess support along the head (i.e., the difference between $W_1$ and $W_2$) may assist the handle in an ability to withstand greater forces, such as, for example, when the head of the multi-use ax is used for striking or prying.

Figure 9:
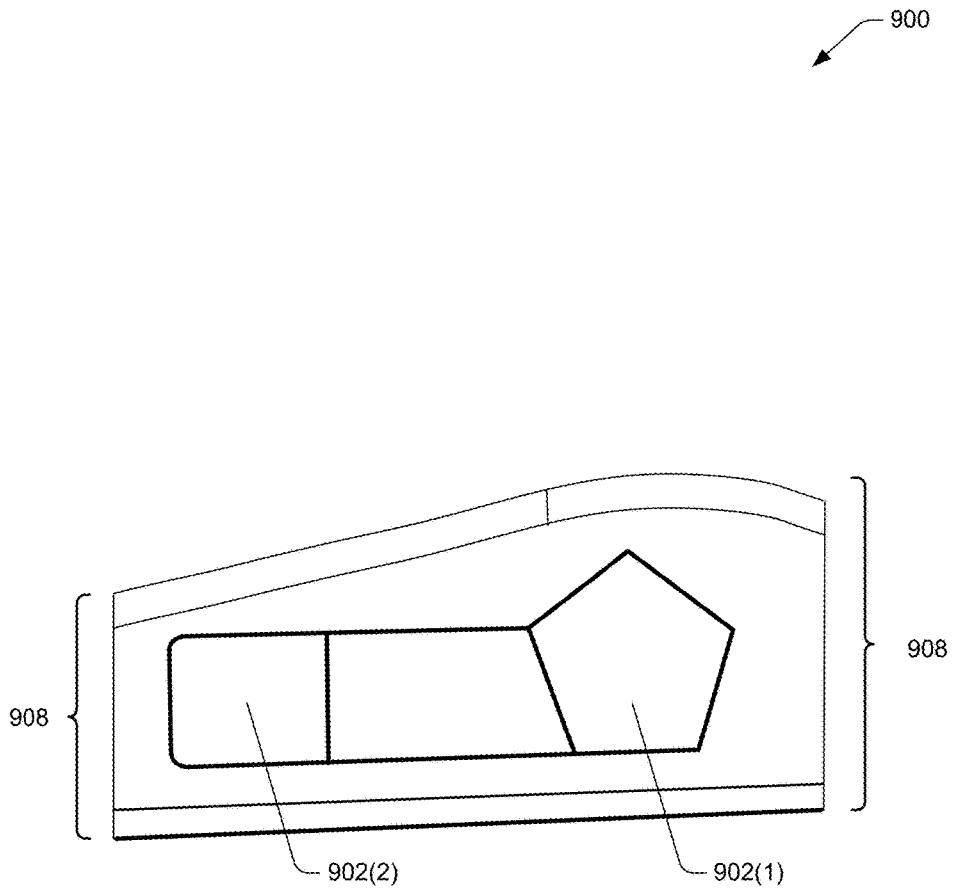
FIG. 9 is an isometric view of wrench holes on a handle of a multi-use ax.

FIG. 9 is an enlarged view of wrench holes on a handle of a multi-use ax, such as multi-use ax 100. In some embodiments, the handle may comprise one wrench hole 902. In some embodiments, the handle may comprise two or more wrench holes 902. In such embodiments, each of the wrench holes may be sized and/or shaped to fit different size/shape bolts.

In the illustrative embodiment, the handle comprises two wrench holes 902(1) and 902(2). Wrench hole 902(1) is configured to fit a pentagonal fire hydrant bolt. Wrench hole 902(2) is configured to fit a square fire hydrant bolt. In at least one embodiment, wrench hole 902(1) is sized to fit a 1½ inch pentagonal fire hydrant operating nut, and wrench hole 902(2) is sized to fit a 1¼ inch square fire hydrant operating nut.

In other embodiments, the wrench holes 902 may be configured to fit an hexagonal, octagonal, or other shaped fire hydrant bolts. In still yet other embodiments, the wrench holes 902 may be rectangular in shape, and may be configured to act as a standard wrench (i.e., gripping two surfaces of the bolt, valve, etc.).

Figure 10A:
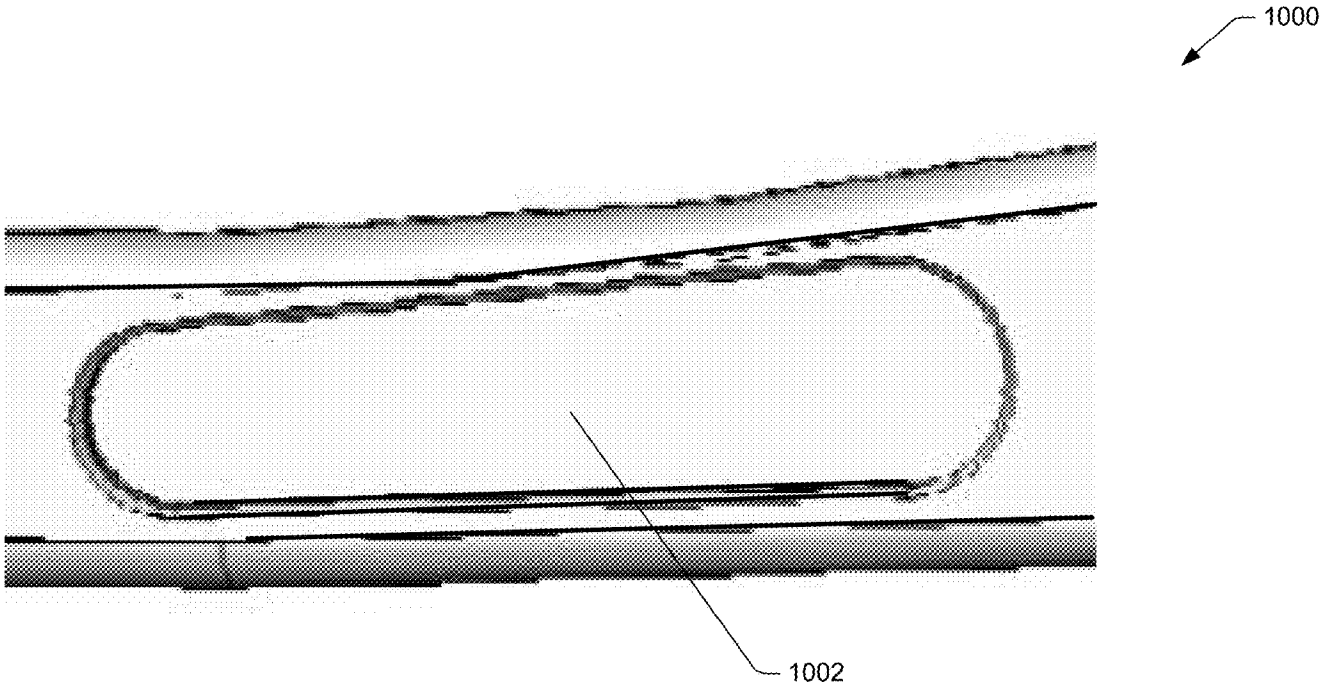
FIGS. 10A and 10B are side views of relief cuts on a handle of a multi-use ax.
Figure 10B:
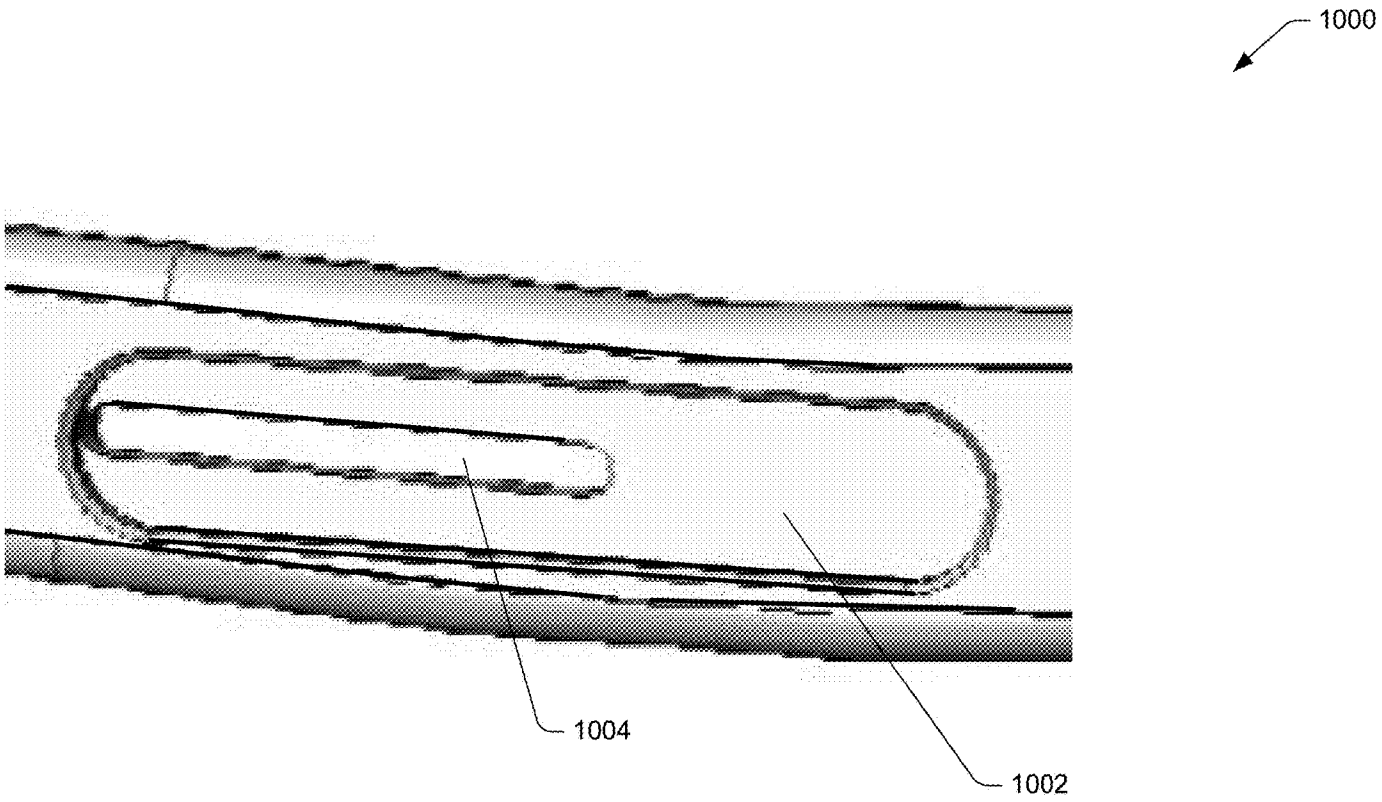

FIGS. 10A and 10B are side views of relief cuts on a handle of a multi-use ax, such as multi-use ax 100. FIG. 10A depicts a substantially ovular relief cut. FIG. 10B depicts a relief cut with a webbing hole.

In various embodiments, the handle of a multi-use ax may comprise one or more relief cuts 1002. The relief cuts 1002 may reduce the weight of the handle, thereby making the multi-use ax more manageable by people of different strengths. As depicted in FIGS. 10A and 10B, the relief cuts 1002 may be substantially ovular. However, in other embodiments, the relief cuts 1002 may be of different shapes (e.g., circular, square, rectangular, or any other shape). In various embodiments, the relief cuts may be chamfered over to ensure there are no sharp edges.

As illustrated in FIG. 10B, at least one relief cut 1002 may comprise a slot 1004, for securing additional equipment to the multi-use ax. The slot 1004 may be rectangular, ovular, circular, square, or any other shape capable of housing webbing, rope, twine, parachute cord, or any other material used for securing equipment. For example, a piece of webbing may be fed through the slot, and used to secure a Halligan style pry tool to the multi-use ax handle. For another example, a piece of parachute cord may be fed through the slot to secure a flashlight to the handle.

Figure 11:
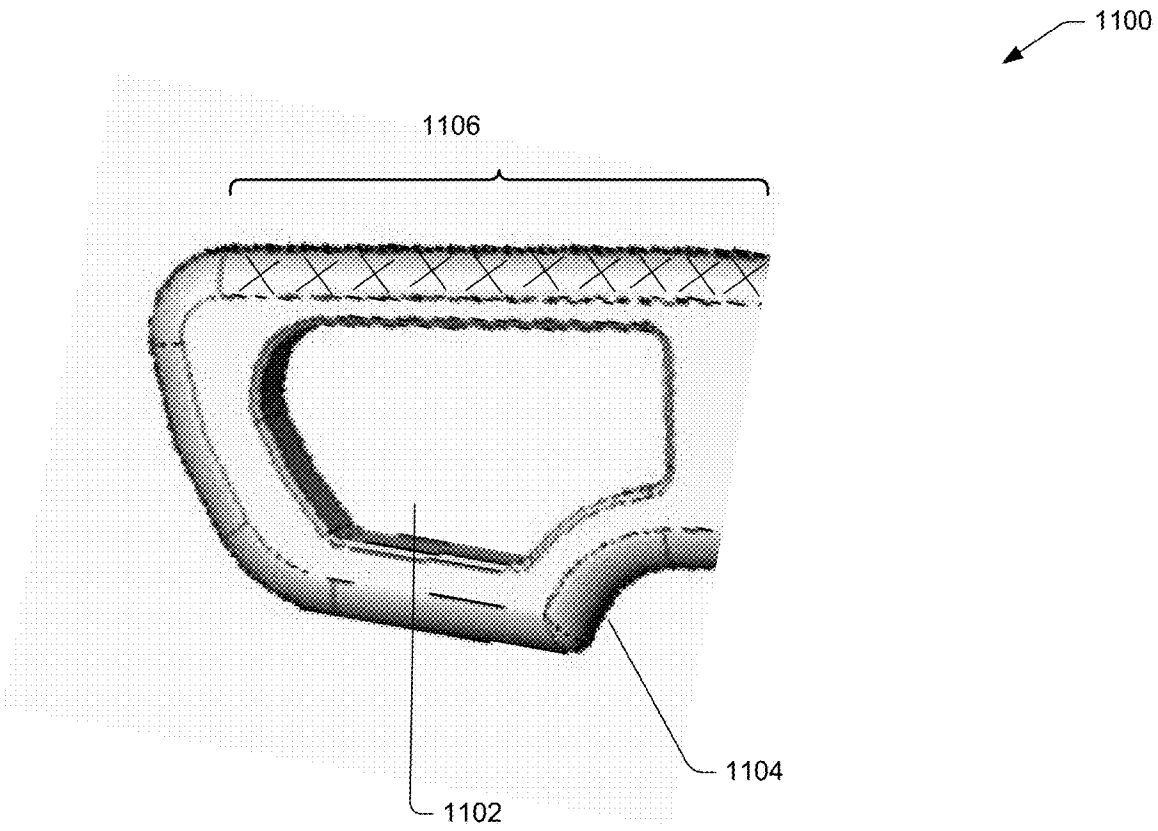
FIG. 11 is a side view of a belay loop on a handle of a multi-use ax.

FIG. 11 is a side view of a belay loop, such as belay loop 128, on a handle of a multi-use ax.

In various embodiments, the belay loop 1102 is configured at the distal end of the multi-use ax handle. In some embodiments, the belay loop 1102 may be configured at a different part of the handle, such as, for example, at a mid-point of the handle. In some embodiments, the belay loop 1102 may be configured at a proximal end of the handle, closer to an anchor point, such as an anchor notch or a pick.

In the illustrative embodiment, the belay loop 1102 is an unbroken loop. In some embodiments, the belay loop 708 may comprise a carabiner (e.g., an auto-locking carabiner, a manual lock carabiner, a non-locking carabiner) with a gate. In such embodiments, a user may be able to place a rope in the belay loop quicker and easier than feeding it in from a bitter end of a rope. For example, the gate of the carabiner may be opened, providing access to the belay loop, such that a rope could be placed inside of the belay loop at a mid-point of the rope (i.e., any point other than an end of the rope).

In various embodiments, the multi-use ax may comprise features to assist with gripping, such as, for example, grip notch 1104 and gripping surface 1106. The grip notch 1104 may be configured to support a gripping hand (i.e., by resting the end of a grip hand, such as a pinky finger, in the notch), and keep the hand from slipping while operating the ax in a swinging motion. The grip notch 1104 may also decrease the grip strength needed to hold the multi-use ax, such as, for example, while walking with the multi-use ax with the head facing down. In some embodiments, the handle may also include a non-slip surface in the grip notch 1104.

In various embodiments, the handle may comprise a gripping surface 1106. The gripping surface 1106 may comprise a non-slip surface, such as a knurled surface, a notched surface, a rubber coating, a non-slip tape, or any other surface used to increase friction at the grip. In various embodiments, the gripping surface 1106 may extend over one or more portions of the handle. In some embodiments, the gripping surface 1106 may extend along the entire length of the handle, thereby providing increased friction and a better grip along the length of the handle. In such embodiments, a user may maintain a solid grip when changing hand positions on the handle.

FIGS. 12-16 illustrate various embodiments of a multi-use ax.

Figure 12:
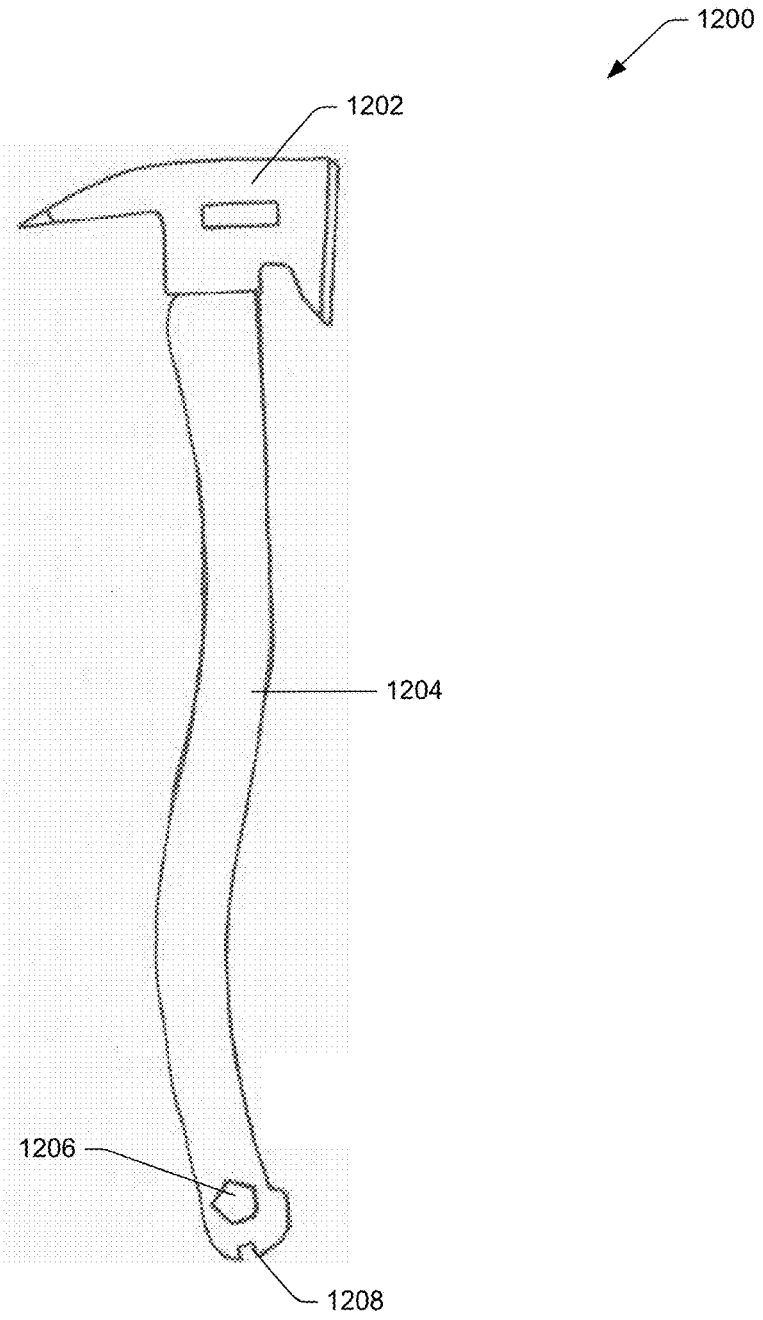
FIG. 12 is a side view of a multi-use ax.

FIG. 12 is a side view of a multi-use ax. Multi-use ax 1200, similar to multi-use ax 100, may comprise a head 1202 and a handle 1204. In various embodiments, handle 1204 may comprise a solid piece of metal, wood, composite material, or combination thereof. In some embodiments, the handle 1204 may comprise relief cuts in order to reduce weight.

In various embodiments, the handle 1204 may extend vertically along an axis, both the front side and the back side of the handle 1204 being straight. In the illustrative embodiment, handle 1204 may be configured with curved surfaces tracking along an axis of the handle. In such an embodiment, the handle may be more ergonomic, and easier to grip at various points along the handle.

In various embodiments, multi-use ax 1200 may comprise a wrench hole 1206. In the illustrative embodiment, the wrench hole 1206 may be configured to fit a pentagonal fire hydrant bolt. In some embodiments, the wrench hole 1206 may be configured to fit bolts of other shapes, such as, for example, square bolts, hexagonal bolts, octagonal bolts, etc. In some embodiments, multi-use ax 1200 may comprise two or more wrench holes 1206 of different shapes and/or sizes.

As illustrated in FIG. 12, multi-use ax 1200 may comprise an end notch 1208. In some embodiments, the end notch 1208 may be used as a gas and/or water shutoff, providing the ability to open and/or close a gas and/or water valve.

Figure 13:
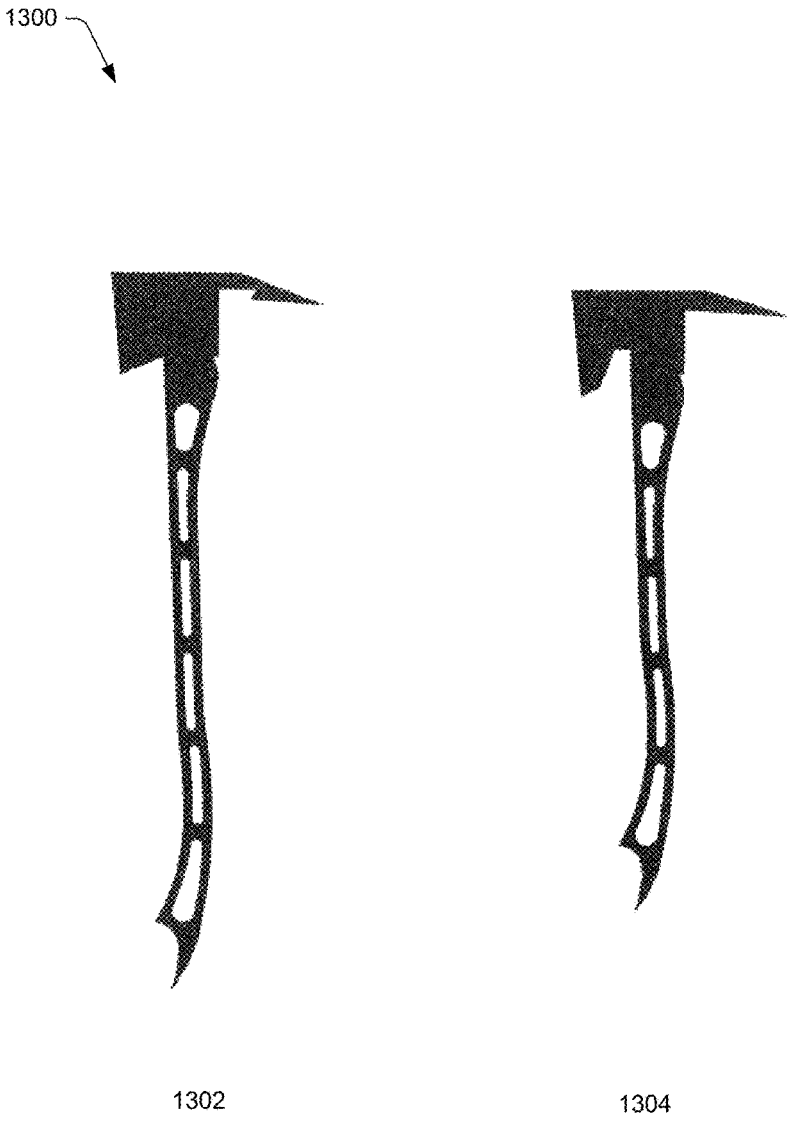
FIG. 13 is a side view of two embodiments of a multi-use ax.

FIG. 13 is a side view of two embodiments of a multi-use ax. Multi-use ax 1302 illustrates a head with an anchor notch, such as anchor notch 118, on the pick. Multi-use ax 1304 illustrates a head with the anchor notch on the beard of the ax face.

Multi-use axes 1302 and 1304 illustrate handles with relief cuts which extend through the width of the handle. In such embodiments, the relief cuts may further decrease the weight of the handle. Additionally, the relief cuts may provide increased flexion of the handle upon head impact, thereby reducing the reverberation felt by a wielder of the multi-use ax.

Figure 14:
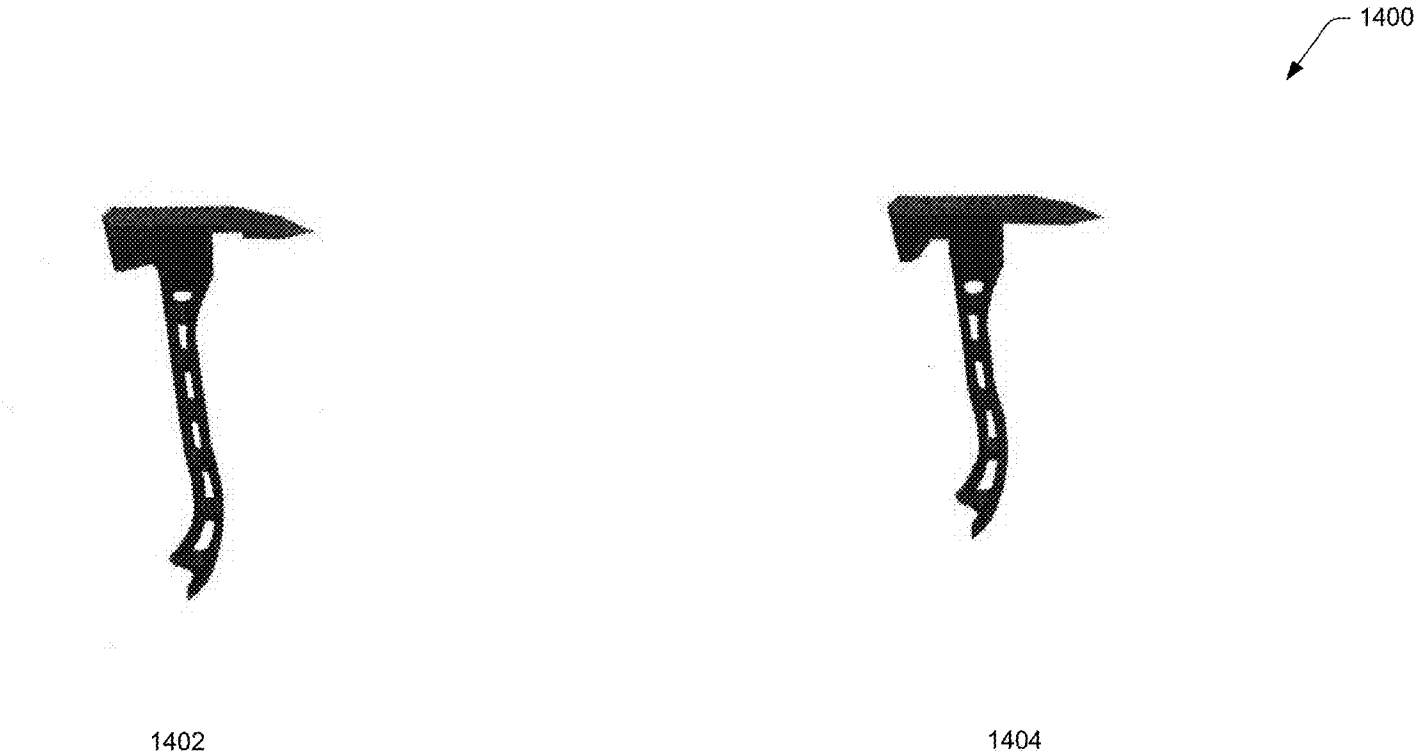
FIG. 14 is a perspective view of the multi-use ax embodiments depicted in FIG. 13.

FIG. 14 is a perspective view of the multi-use ax embodiments depicted in FIG. 13.

Figure 15:
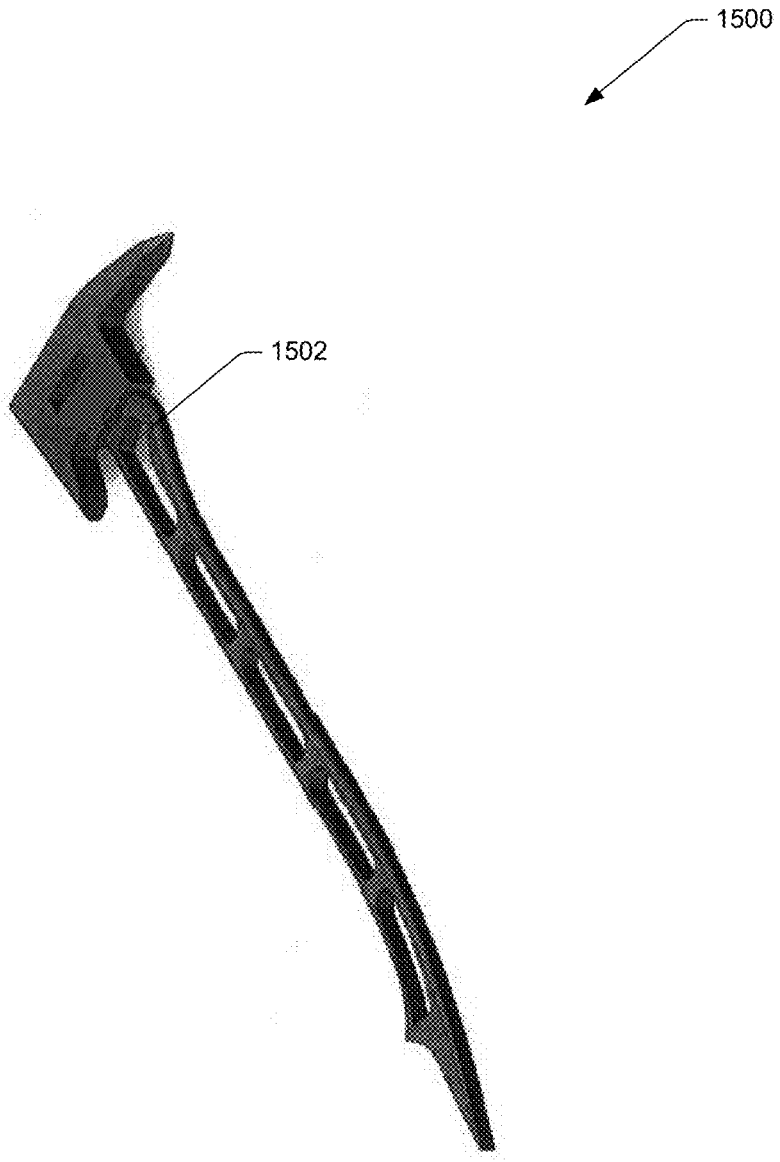
FIG. 15 is a perspective view of a multi-use ax.

FIG. 15 is a perspective view of another multi-use ax. Multi-use ax 1500, similar to multi-use axes 1302 and 1304, comprise relief cuts which extend through the handle.

Figure 16:
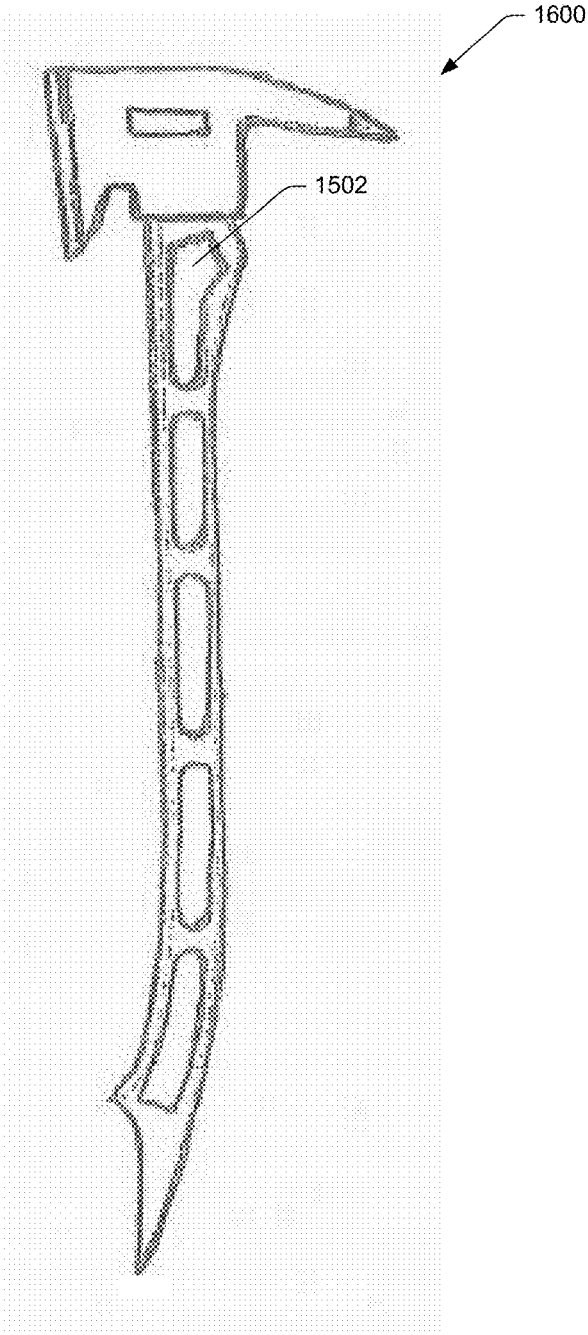
FIG. 16 is a side view of the multi-use ax depicted in FIG. 15.

In various embodiments, one or more of the relief cuts may comprise a wrench hole 1502. In the illustrative embodiment, wrench hole 1502 is shaped to fit a pentagonal bolt. In some embodiments, the wrench hole 1502 may be shaped to fit a pentagonal fire hydrant bolt. In other embodiments, the wrench hole 1502 may be shaped to fit bolts of other shapes or sizes. FIG. 16 is a side view of the multi-use ax depicted in FIG. 15.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A device comprising:

a handle having a longitudinal axis defining a vertical direction;

a head comprising:

a first top surface comprising a traction feature;

an ax face comprising a blunt surface, the blunt surface having a top end proximate the first top surface and a bottom end, the blunt surface being flanked by beveled edges and comprising a substantially flat surface;

a pick comprising:

a first pick portion having a first width that is substantially a same width as the head of the device, the first pick portion of the pick extending away from the ax face; and a second pick portion extending away from the first pick portion and having a tapering width that tapers from the first width to a point, wherein:

a thickness of the pick tapers uniformly across the first pick portion and the second pick portion, the first pick portion having a second top surface;

the second pick portion has a third top surface and a bottom surface that come to the point with two lateral side surfaces; and the second top surface and the third top surface define a generally flat upper surface of the pick; and an anchor notch comprising:

a first notch portion extending away from the first top surface of the head, towards the handle of the device, and in a first direction substantially in parallel with the vertical direction, the first notch portion being connected with a surface of the handle of the device;

a second notch portion spanning between a top end of the first notch portion and a top end of a third notch portion of the anchor notch, wherein the second notch portion extends in a second direction that is transverse to the first direction; and the third notch portion extending in a third direction transverse to the second direction and defining a perimeter that is convex, wherein the third notch portion connects to the bottom end of the blunt surface; and the handle comprising:

a proximal end coupled to the first notch portion of the anchor notch head and a distal end, wherein the handle has a total length extending generally in the vertical direction from the proximal end to the distal end;

one or more wrench holes; and a belay loop, the belay loop comprising a hole through a second width of the handle a distance from the head providing a belay point with respect to the anchor notch or the pick, the distance greater than one half of the total length of the handle.

2. The device as recited in claim 1, the handle further comprising a tenon, the head further comprising a mortise with one or more roll pin holes, the mortise being configured to make a connection with the tenon in the handle, wherein the mortise and the tenon are hydraulically pressed together, and one or more roll pins inserted in the one or more roll pin holes further secure the connection.

3. The device as recited in claim 1, wherein the head further comprises a hole configured to house a pry tool.

4. The device as recited in claim 1, wherein the blunt surface of the ax face is angled 5 degrees from the vertical direction and the beveled edges are angled 45 degrees from the blunt surface.

5. The device as recited in claim 1, wherein the first top surface comprises a cutout, the cutout configured as tool for:

a gas valve shutoff; or a water valve shutoff.

6. The device as recited in claim 1, wherein the traction feature comprises at least one of:

a surface texture;

a plastic component; and a rubber component.

7. The device as recited in claim 1, wherein the generally flat upper surface of the pick is configured at a 10 degree angle from a horizontal reference axis.

8. A multi-use ax comprising:

a head comprising:

an ax face comprising:

a first beveled edge flanking a blunt surface, wherein the first beveled edge has a first width;

a second beveled edge flanking the blunt surface, wherein the second beveled edge has a second width;

the blunt surface comprising a substantially flat surface, the blunt surface having a third width;

a pick comprising:

a first portion having a uniform fourth width that is substantially a same width as the head of the multi-use axe, the first portion of the pick extending away from the ax face; and a second portion extending away from the first portion and having a tapering width that tapers from the uniform fourth width to a point, wherein:

a thickness of the pick tapers uniformly across the first portion and the second portion, the first portion having a first top surface;

the second portion has a second top surface and a bottom surface that come to the point with two lateral side surfaces; and the first top surface and the second top surface define a generally flat upper surface of the pick; and an anchor notch;

a handle comprising a proximal end coupled to the head and a distal end;

one or more wrench holes, each of the one or more wrench holes comprising a polygonal shape; and a belay loop, the belay loop comprising a hole through a fifth width of the handle a distance from the head providing a belay point with respect to the anchor notch or the pick, the distance greater than one half of a total length of the handle.

9. The multi-use ax as recited in claim 8, wherein the head further comprises:

a third top surface comprising a traction feature; and a hole configured to house a pry tool.

10. The multi-use ax as recited in claim 8, wherein the blunt surface of the ax face is angled 5 degrees from a reference axis and the first beveled edge and the second beveled edge are angled 45 degrees relative to the blunt surface, the reference axis extending in parallel to a longitudinal axis of the handle of the ax.

11. The multi-use ax as recited in claim 8, wherein a transition between the first beveled edge and the blunt surface comprises a curved surface.

12. The multi-use ax as recited in claim 8, wherein the head further comprises a hole configured to house a pry tool.

13. A striking implement comprising:

a handle;

a head comprising:

a first top surface;

an ax face;

a pick comprising:

a first pick portion having a first width that is substantially a same width as the head of the striking implement, the first pick portion of the pick extending away from the ax face; and a second pick portion extending away from the first pick portion and having a tapering width that tapers from the first width to a point, wherein:

a thickness of the pick tapers uniformly across the first pick portion and the second pick portion, the first pick portion having a second top surface;

the second pick portion has a third top surface and a bottom surface that come to the point with two lateral side surfaces; and the second top surface and the third top surface define a generally flat upper surface of the pick; and an anchor notch comprising:

a first notch portion extending away from the first top surface of the head towards the handle of the striking implement, the first notch portion being connected with the handle and extending in a first direction substantially parallel with a longitudinal axis of the handle;

a second notch portion spanning between a top end of the first notch portion and a top end of a third notch portion of the anchor notch, wherein the second notch portion extends in a second direction that is transverse to the first direction; and the third notch portion extending in a third direction transverse to the second direction, wherein the third notch portion defines a perimeter that is substantially convex;

the handle comprising:

a proximal end coupled to the head and a distal end, wherein the handle comprises a second width, and a length extending from the proximal end to the distal end;

one or more wrench holes disposed through at least a portion of the second width of the handle and located a first distance from the head, the first distance being less than one half of the length of the handle; and a belay loop comprising a hole through the second width of the handle and located a second distance from the head, the second distance being greater than one half of the length of the handle.

14. The striking implement as recited in claim 13, wherein the one or more wrench holes comprise:

a first wrench hole comprising a first polygonal shape; and a second wrench hole comprising a second polygonal shape different than the first polygonal shape.

15. The striking implement as recited in claim 14, wherein the first polygonal shape comprises one of a square shape, a pentagonal shape, a hexagonal shape, or an octagonal shape.

16. The striking implement as recited in claim 14, wherein the first polygonal shape of the first wrench hole is that of a pentagonal shape, the pentagonal shape being sized to fit a 1½-inch fire hydrant operating nut.

17. The striking implement as recited in claim 16, wherein the second polygonal shape of the second wrench hole is that of a square shape, the square shape being sized to fit a 1¼-inch fire hydrant operating nut.

18. The striking implement as recited in claim 14, wherein the first wrench hole has a first missing portion in a first perimeter of the first polygonal shape that overlaps at least partially with a second missing portion in a second perimeter of the second polygonal shape of the second wrench hole.

* * * * *